US009822932B2

(12) United States Patent
Hyde et al.

(10) Patent No.: US 9,822,932 B2
(45) Date of Patent: Nov. 21, 2017

(54) CHILLED CLATHRATE TRANSPORTATION SYSTEM

(75) Inventors: Roderick A. Hyde, Redmond, WA (US); Lowell L. Wood, Jr., Bellevue, WA (US)

(73) Assignee: Elwha LLC

( * ) Notice: Subject to any disclaimer, the term of this patent is extended or adjusted under 35 U.S.C. 154(b) by 1024 days.

(21) Appl. No.: 13/488,166

(22) Filed: Jun. 4, 2012

(65) Prior Publication Data

US 2013/0319531 A1 Dec. 5, 2013

(51) Int. Cl.
*F17D 1/04* (2006.01)
*F17D 1/08* (2006.01)

(52) U.S. Cl.
CPC ..... *F17D 1/04* (2013.01); *F17D 1/08* (2013.01); *Y10T 137/0318* (2015.04); *Y10T 137/0391* (2015.04); *Y10T 137/6416* (2015.04); *Y10T 137/87265* (2015.04)

(58) Field of Classification Search
USPC ..... 137/339, 340, 89, 110, 599.14; 166/52, 166/302; 299/3–7; 165/45, 104.26, 154
See application file for complete search history.

(56) References Cited

U.S. PATENT DOCUMENTS 3,316,931 A 5/1967 Elrod
3,493,050 A * 2/1970 Kelley ..... E21B 43/2401 166/267
3,514,274 A 5/1970 Cahn et al.
3,648,767 A * 3/1972 Balch ..... F24J 3/086 165/104.19
3,650,119 A * 3/1972 Sparling ..... F16L 1/026 137/236.1
3,674,086 A * 7/1972 Foster ..... 165/45
3,735,769 A 5/1973 Miller
3,756,268 A * 9/1973 Lefever et al. ..... 137/340
3,906,972 A 9/1975 Jensen et al.
3,943,965 A 3/1976 Matelena
3,975,167 A 8/1976 Nierman
4,266,958 A 5/1981 Cummings
(Continued)

FOREIGN PATENT DOCUMENTS

WO WO 01/38781 A1 5/2001
WO WO 01/48367 A1 7/2001

OTHER PUBLICATIONS

PCT International Search Report; International App. No. PCT/US2013/042643; dated Dec. 13, 2013; pp. 1-2.
(Continued)

*Primary Examiner* — Michael R Reid
*Assistant Examiner* — Jonathan Waddy

(57) ABSTRACT

Described embodiments include a system and a method. A described system includes a pipeline system. The pipeline system includes a transportation conduit containing a natural gas hydrate flowing from a first geographic location to a second geographic location. The pipeline system includes a cooling conduit running parallel to the transportation conduit, and having a heat-transfer surface thermally coupled with the flowing natural gas hydrate. The cooling conduit contains a heat-transfer fluid flowing between the first geographic location and the second geographic location. The flowing heat-transfer fluid has a target temperature range predicted to maintain a selected stability of the flowing natural gas hydrate.

27 Claims, 12 Drawing Sheets

(56) References Cited

U.S. PATENT DOCUMENTS

| | | | | |
|---|---|---|---|---|
| 4,776,181 | A | 10/1988 | Maule | |
| 4,976,100 | A | 12/1990 | Lee | |
| 5,056,588 | A | 10/1991 | Carr | |
| 5,803,161 | A * | 9/1998 | Wahle | F28D 15/0233 165/104.21 |
| 6,012,292 | A | 1/2000 | Gulati et al. | |
| 6,307,191 | B1 | 10/2001 | Waycuilis | |
| 6,350,928 | B1 | 2/2002 | Waycuilis et al. | |
| 6,585,047 | B2 * | 7/2003 | McClung, III | 166/302 |
| 6,703,534 | B2 | 3/2004 | Waycuilis et al. | |
| 6,774,276 | B1 | 8/2004 | Lund et al. | |
| 7,958,939 | B2 | 6/2011 | Talley | |
| 2002/0120172 | A1 | 8/2002 | Waycuilis et al. | |
| 2004/0187518 | A1 | 9/2004 | Laude Bousquet | |
| 2005/0059846 | A1 | 3/2005 | Kohda et al. | |
| 2005/0284612 | A1 | 12/2005 | Machiroutu | |
| 2006/0201180 | A1 | 9/2006 | Kidwell et al. | |
| 2007/0062704 | A1 * | 3/2007 | Smith | 166/303 |
| 2008/0209916 | A1 | 9/2008 | White | |
| 2008/0257315 | A1 * | 10/2008 | Thomas | F02M 31/18 123/548 |
| 2008/0264099 | A1 | 10/2008 | Mock et al. | |
| 2009/0035627 | A1 | 2/2009 | Tohidi et al. | |
| 2009/0124520 | A1 | 5/2009 | Tohidi | |
| 2009/0166032 | A1 | 7/2009 | Carr, Sr. | |
| 2009/0221451 | A1 | 9/2009 | Talley | |
| 2010/0006291 | A1 | 1/2010 | Poorte | |
| 2010/0145115 | A1 | 6/2010 | Lund et al. | |
| 2010/0200237 | A1 | 8/2010 | Colgate et al. | |
| 2010/0236634 | A1 | 9/2010 | Nuland et al. | |
| 2011/0185623 | A1 | 8/2011 | Cooper et al. | |
| 2011/0308625 | A1 | 12/2011 | Stoisits et al. | |
| 2012/0070344 | A1 | 3/2012 | Carstens et al. | |

OTHER PUBLICATIONS

Andersson, Vibeke et al., "Transporting Oil and Gas as Hydrate Slurries", 14th Int. Conf. on Slurry Handling and Pipeline Transport, Hydrotransport 14, Sep. 8-10, 1999, pp. 1-7, Maastricht, The Netherlands.

Daimaru, Takamichi et al., "Energy Saving Potential for Natural Gas Hydrate Transportation", Prepr. Pap.-Am. Chem. Soc., Div. Fuel Chem, 2004, vol. 49, No. 1, pp. 190-191.

Gudmundsson, J.S. et al., "Frozen Hydrate for Transport of Natural Gas", 2nd International Conference on Natural Gas Hydrate, Jun. 2-6, 1996, pp. 1-8, Toulouse, France.

Iwata, Zensuke et al., "Heat Pipe Local Cooling System Applied for 145 KV Transmission Lines in Copenhagen", 1991, pp. 52-60, IEEE.

Javanmardi, J. et al., "Natural Gas Hydrate, an Alternative for Transportation of Natural Gas", printed on Feb. 24, 2004, pp. 1-6, located at: http://www.ipt.ntnu.no/~ngh/library/paper2.html.

Javanmardi, J. et al., "Economic Evaluation of Natural Gas Hydrate Gas Transportation", Applied Thermal Engineering, Aug. 2005, pp. 1708-1723, vol. 25, Issue 11-12, Elsevier Ltd.

Kanda, H. "Economic Study on Natural Gas Transportation with Natural Gas Hydrate (NGH) Pellets", 23rd World Gas Conference, 2006, pp. 1-11, Amsterdam.

Shi, Guohua et al., "Prospects of Natural Gas Storage and Transportation Using Hydrate Technology in China", ICIEA, 2009, pp. 530-534, IEEE.

Sloan, E. Dendy, Jr., "Fundamental Principles and Applications of Natural Gas Hydrates", Nature, Nov. 20, 2003, pp. 353-359, vol. 426, Nature Publishing Group.

Thomas, Sydney et al., "Review of Ways to Transport Natural Gas Energy From Countries Which Do Not Need the Gas for Domestic Use", Energy, 2003, pp. 1461-1477, vol. 28, Elsevier Ltd.

Turner, Doug et al., "Hydrate Inhibition via Cold Flow—No Chemicals or Insulation", Proceedings of the 6th International Conference on Gas Hydrates (ICGH 2008), Jul. 6-10, 2008, pp. 1-12, Vancouver, Canada.

"An Introduction to Natural Gas Hydrate/Clathrate: The Major Organic Carbon Reserve of the Earth", Journal of Petroleum Science and Engineering, 2007, pp. 1-8, vol. 56, Elsevier B.V.

"Clathrate Compound", Wikipedia; printed on Apr. 11, 2012, pp. 1-3, located at: http://en.wikipedia.org/wiki/Clathrate.

"Methane Hydrate: A Surprising Compound", printed on Apr. 23, 2012, pp. 1-6, Science & Technology Review, located at: https://www.llnl.gov/str/Durham.html?pagewanted=all.

"Transport of Natural Gas Hydrates (NGH)", Jul. 2011, pp. 1-2, located at: http://www.marathonoil.com/content/inline-images/marathon_com/about_us/technology/NatGasHydrates_Nobio_FINAL.pdf.

PCT International Search Report; International App. No. PCT/US2013/042633; dated Oct. 8, 2013; pp. 1-2.

PCT International Search Report; International App. No. PCT/US2013/042625; dated Oct. 22, 2013; pp. 1-2.

"Thermal Conductivity," located at https://web.archive.org/web/20091212003726/http://hyperphysics.phy-astr.gsu.edu/hbase/tables/thren.html, bearing a date of Jul. 27, 2015, 3 pages, HyperPhysics.

"Freezing, but not cold," Buried Treasure—The Why Files, located at https://web.archive.org/web/20001029085442/http://whyfiles.org/119nat_gas/3.html, bearing a date of Jul. 27, 2015, 4 pages, University of Wisconsin.

* cited by examiner

200
B
B
112
122
116
118
132
119
A
A
117
124
130
110
220
230-238
240
250
242
220
230-238
240
250
260

Section A-A

Section A-A

Section A-A

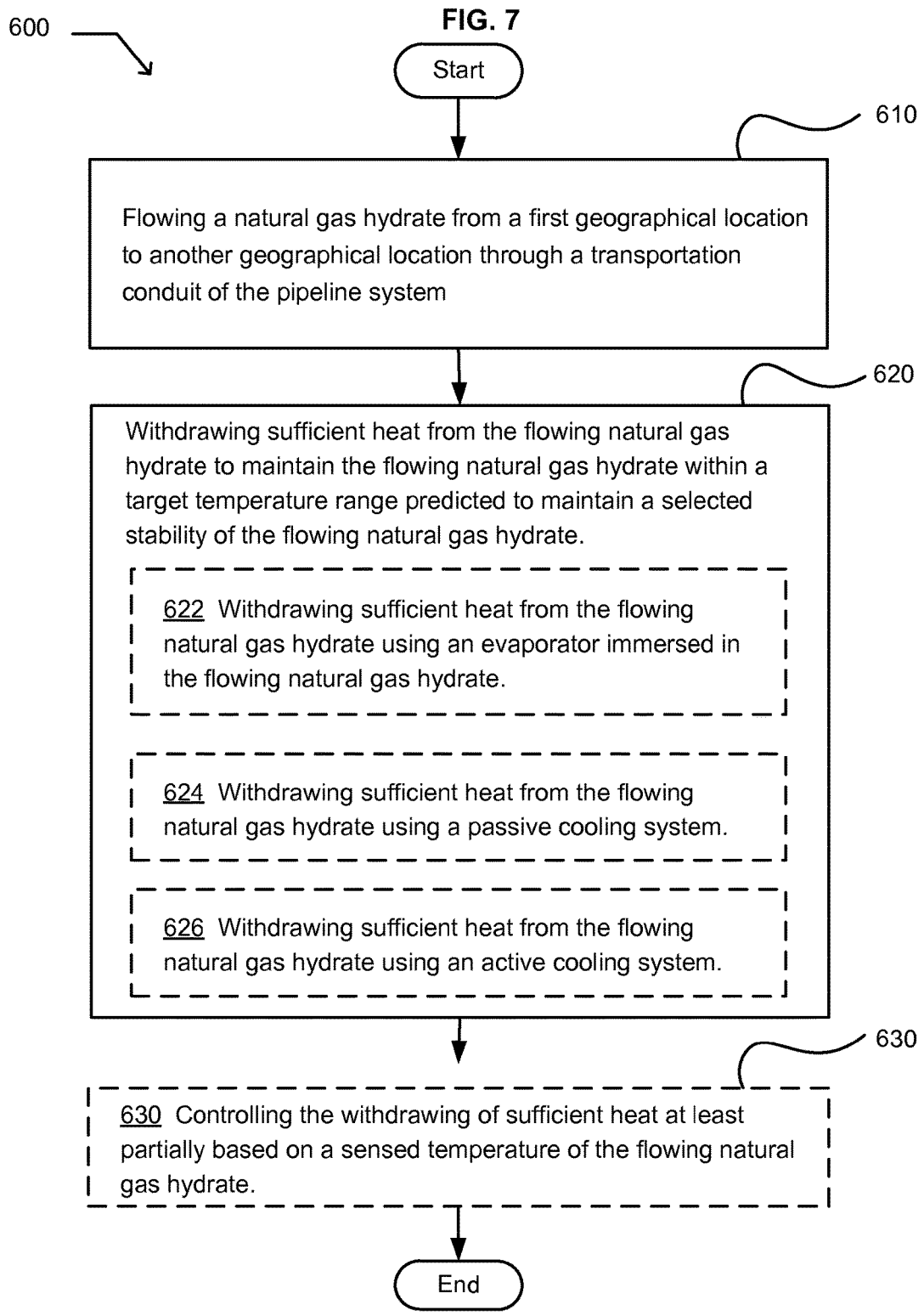
600
FIG. 7
Start
610
Flowing a natural gas hydrate from a first geographical location to another geographical location through a transportation conduit of the pipeline system
620
Withdrawing sufficient heat from the flowing natural gas hydrate to maintain the flowing natural gas hydrate within a target temperature range predicted to maintain a selected stability of the flowing natural gas hydrate.
622 Withdrawing sufficient heat from the flowing natural gas hydrate using an evaporator immersed in the flowing natural gas hydrate.
624 Withdrawing sufficient heat from the flowing natural gas hydrate using a passive cooling system.
626 Withdrawing sufficient heat from the flowing natural gas hydrate using an active cooling system.
630
630 Controlling the withdrawing of sufficient heat at least partially based on a sensed temperature of the flowing natural gas hydrate.
End

CHILLED CLATHRATE TRANSPORTATION SYSTEM

CROSS-REFERENCE TO RELATED APPLICATIONS

The present application is related to and claims the benefit of the earliest available effective filing date(s) from the following listed application(s) (the "Related Applications") (e.g., claims earliest available priority dates for other than provisional patent applications or claims benefits under 35 USC §119(e) for provisional patent applications, for any and all parent, grandparent, great-grandparent, etc. applications of the Related Application(s)).

RELATED APPLICATIONS

For purposes of the USPTO extra-statutory requirements, the present application constitutes a continuation-in-part of U.S. patent application Ser. No. 13/488,217, entitled DIRECT COOLING OF CLATHRATE FLOWING IN A PIPELINE SYSTEM, naming Roderick A. Hyde, and Lowell L. Wood, Jr., as inventors, filed Jun. 4, 2012, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 13/488,261, entitled FLUID RECOVERY IN CHILLED CLATHRATE TRANSPORTATION SYSTEMS, naming Roderick A. Hyde, and Lowell L. Wood, Jr., as inventors, filed Jun. 4, 2012, which is currently co-pending, or is an application of which a currently co-pending application is entitled to the benefit of the filing date.

The United States Patent Office (USPTO) has published a notice to the effect that the USPTO's computer programs require that patent applicants reference both a serial number and indicate whether an application is a continuation or continuation-in-part. Stephen G. Kunin, Benefit of Prior-Filed Application, USPTO Official Gazette Mar. 18, 2003. The present Applicant Entity (hereinafter "Applicant") has provided above a specific reference to the application(s) from which priority is being claimed as recited by statute. Applicant understands that the statute is unambiguous in its specific reference language and does not require either a serial number or any characterization, such as "continuation" or "continuation-in-part," for claiming priority to U.S. patent applications. Notwithstanding the foregoing, Applicant understands that the USPTO's computer programs have certain data entry requirements, and hence Applicant is designating the present application as a continuation-in-part of its parent applications as set forth above, but expressly points out that such designations are not to be construed in any way as any type of commentary or admission as to whether or not the present application contains any new matter in addition to the matter of its parent application(s).

All subject matter of the Related Applications and of any and all parent, grandparent, great-grandparent, etc. applications of the Related Applications is incorporated herein by reference to the extent that such subject matter is not inconsistent herewith.

SUMMARY

For example, and without limitation, an embodiment of the subject matter described herein includes a pipeline system. The pipeline system includes a transportation conduit containing a natural gas hydrate flowing from a first geographic location to a second geographic location. The pipeline system includes a cooling conduit running parallel to the transportation conduit, and having a heat-transfer surface thermally coupled with the flowing natural gas hydrate. The cooling conduit contains a heat-transfer fluid flowing between the first geographic location and the second geographic location. The flowing heat-transfer fluid has a target temperature range predicted to maintain a selected stability of the flowing natural gas hydrate.

In an embodiment, the target temperature range is predicted to maintain a selected stability of the flowing natural gas hydrate during a transit of a portion of the transportation conduit. In an embodiment, the pipeline system includes an exhaust system configured to vent a portion of the heat-transfer fluid after the heat-transfer fluid has undergone a phase change. In an embodiment, the pipeline system includes a return-conduit running between the second geographical location and the first geographical location. The return-conduit contains a portion of the heat-transfer fluid withdrawn from the cooling conduit at the second geographical location. The withdrawn heat-transfer fluid is flowing from the second geographical location toward the first geographical location. In an embodiment, the pipeline system includes a cooling system configured to cool the heat-transfer fluid to the target temperature range. In an embodiment, the pipeline system includes a removal system withdrawing at least a portion of the heat-transfer fluid from the cooling conduit. The pipeline system in this embodiment also includes an injection system introducing the withdrawn heat-transfer fluid into the cooling conduit after cooling of the withdrawn heat-transfer fluid by the cooling system. In an embodiment, the pipeline system includes a hydrate pump urging the flowing natural gas hydrate toward the second geographic location. In an embodiment, the pipeline system includes a fluid pump urging the flowing of the heat-transfer fluid from the first geographical location toward the second geographical location, or from the second geographical location toward the first geographical location. In an embodiment, the pipeline system includes an insulating material separating the transportation conduit from the ambient temperature of the environment surrounding the transportation conduit. In an embodiment, the pipeline system includes a controller configured to control a pressure or temperature of the flowing heat-transfer fluid.

For example, and without limitation, an embodiment of the subject matter described herein includes a pipeline system. The pipeline system includes a transportation conduit configured to contain a natural gas hydrate flowing from a first geographic location to a second geographic location. The pipeline system includes a cooling conduit running parallel to the transportation conduit, and having a heat-transfer surface thermally coupled with the natural gas hydrate contained within the transportation conduit. The cooling conduit is configured to contain a heat-transfer fluid flowing between the first geographic location and the second geographic location. The pipeline system includes a cooling system configured to cool the heat-transfer fluid to a target temperature range predicted to maintain a selected stability of the natural gas hydrate contained by and flowing through the transportation conduit.

In an embodiment, the pipeline system includes a removal system configured to withdraw at least a portion of the heat-transfer fluid from the cooling conduit. In this embodiment, the pipeline system also includes an injection system configured to introduce the withdrawn heat-transfer fluid into the cooling conduit after cooling of the withdrawn heat-transfer fluid by the cooling system. In an embodiment, the pipeline system includes a hydrate pump configured to urge the flow of the natural gas hydrate toward the second geographic location. In an embodiment, the pipeline system includes a fluid pump configured to urge the flow of the heat-transfer fluid toward the second geographical location, or toward the first geographical location.

For example, and without limitation, an embodiment of the subject matter described herein includes a pipeline system. The pipeline system includes a transportation conduit containing a gas clathrate flowing from a first geographical location to a second geographical location. The pipeline system includes a cooling conduit running parallel to the transportation conduit, and having a heat-transfer surface thermally coupled with the flowing gas clathrate. The cooling conduit contains a flowing heat-transfer fluid. The flowing heat-transfer fluid has a target temperature range predicted to maintain a selected stability of the gas clathrate flowing from the first geographical location to the second geographical location.

In an embodiment, the pipeline system includes a cooling system configured to cool the heat-transfer fluid to the target temperature range. In an embodiment, the pipeline system includes a pump system configured to urge the flowing gas clathrate from the first geographical location to the second geographical location. In an embodiment, the pipeline system includes a pump system configured to urge the flowing heat-transfer fluid from the first geographical location toward the second geographical location, or from the second geographical location toward the first geographical location.

For example, and without limitation, an embodiment of the subject matter described herein includes a pipeline system. The pipeline system includes a transportation conduit configured to contain a gas clathrate flowing from a first geographic location to a second geographic location. The pipeline system includes a cooling conduit running parallel to the transportation conduit, and having a heat-transfer surface thermally coupled with gas clathrate contained within the transportation conduit. The cooling conduit is configured to contain a heat-transfer fluid flowing between the first geographic location and the second geographic location. The pipeline system includes a cooling system configured to cool the heat-transfer fluid to a target temperature range predicted to maintain a selected stability of gas clathrate contained by and flowing through the transportation conduit.

For example, and without limitation, an embodiment of the subject matter described herein includes a method implemented in a pipeline system. The method includes flowing a gas clathrate from a first geographic location to a second geographic location through a transportation conduit of the pipeline system. The method includes flowing a heat-transfer fluid between the first geographic location and the second geographic location through a cooling conduit of the pipeline system. The cooling conduit running parallel to the transportation conduit and having a heat-transfer surface thermally coupled with the flowing gas clathrate. The flowing heat-transfer fluid has a target temperature range predicted to maintain a selected stability of the flowing gas clathrate.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIG. 7 illustrates an example operational flow 600 implemented in a pipeline transportation system;

DETAILED DESCRIPTION

Figure 1:
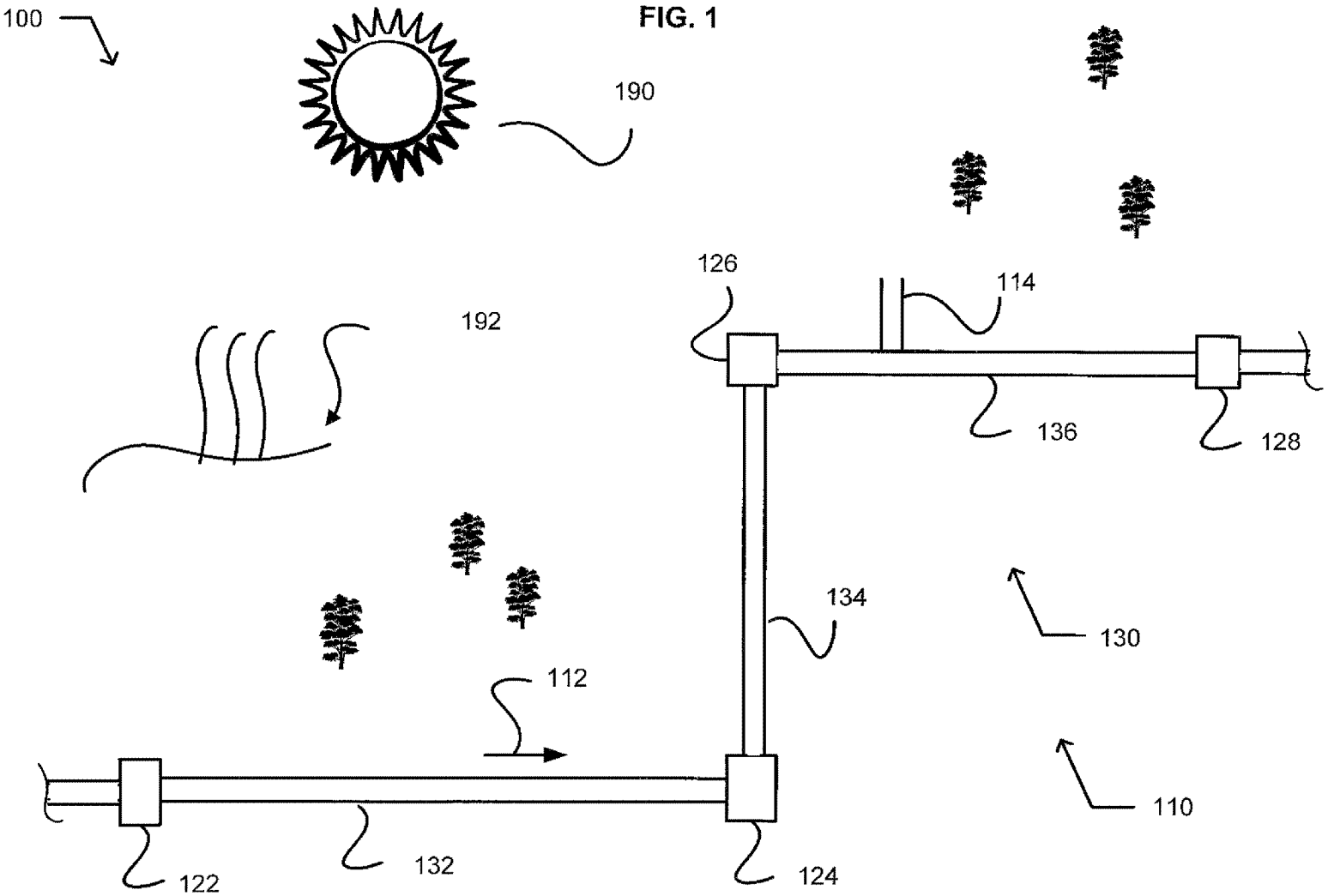
FIG. 1 illustrates an example environment 100 in which embodiments may be implemented.

In the following detailed description, reference is made to the accompanying drawings, which form a part hereof. In the drawings, similar symbols typically identify similar components, unless context dictates otherwise. The illustrated embodiments described in the detailed description, drawings, and claims are not meant to be limiting. Other embodiments may be utilized, and other changes may be made, without departing from the spirit or scope of the subject matter presented here.

FIG. 1 illustrates an example environment 100 in which embodiments may be implemented. The environment includes a pipeline system 110 transporting or configured to transport a natural gas hydrate from one geographic location to another geographic location. For example, in an embodiment, a first geographic location 122 may be a city, such as Seattle, and a second geographic location 124 may be another city, such as Tacoma, Wash. A third geographic location 126 may be a location of a pumping station or other pipeline machinery, a pipeline related structure, or another city. For example, the third geographic location may be a location between Tacoma and Olympia, or a geographic location between Olympia and Portland, Oreg. For example, in an embodiment, the first geographic location 122, the second geographic location 124, the third geographic location 126, and a fourth location 128 may each be about a mile apart along the pipeline system. For example, the pipeline system may include a transcontinental pipeline system, interstate pipeline system, intrastate pipeline system, city to city pipeline system, or a portion of the distance between these locations. The environment also includes the sun 190 heating air or soil proximate to the pipeline system to an ambient temperature 192.

The pipeline system 110 includes a pipeline 130. The pipeline is illustrated has having multiple segments, illustrated as segment 132, segment 134, and segment 136.

Figures 2, 2A, 2B, 2C:
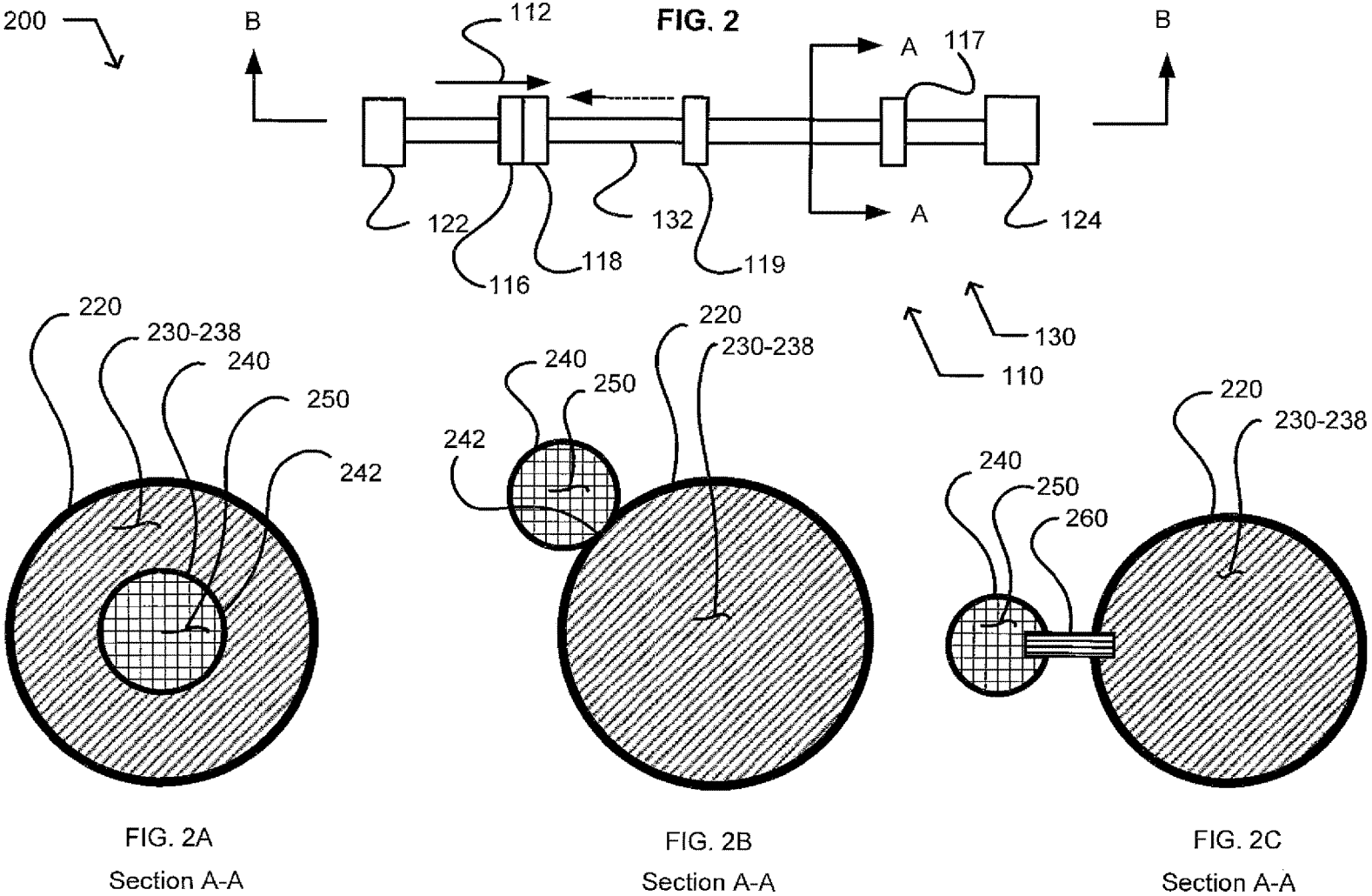
FIG. 2 illustrates an example environment 200 in which embodiments may be implemented.

FIG. 2 illustrates an example environment 200 in which embodiments may be implemented. The environment illustrates the segment 132 of the pipeline 130 running between geographic location 122 and 124. FIGS. 2A-2C illustrate several alternative embodiments of the pipeline at cross-section A-A. In these illustrated alternative embodiments, the pipeline includes a transportation conduit 220 containing a natural gas hydrate 234 flowing in direction 112 from the first geographic location 122 to the second geographic location 124. In these illustrated alternative embodiments, the pipeline includes a cooling conduit 240 running parallel to the transportation conduit, having a heat-transfer surface 242 thermally coupled with the flowing natural gas hydrate, and containing a heat-transfer fluid 250 flowing between the first geographic location and the second geographic location. For example, the heat-transfer fluid may include a gas, a liquid, a slurry containing a solid undergoing a phase change to a liquid, or a liquid undergoing a phase change to a gas. The flowing heat-transfer fluid has a target temperature range predicted to maintain a selected stability of the flowing natural gas hydrate.

Natural gas is a gaseous fossil fuel consisting primarily of methane but often including significant quantities of ethane, propane, butane, pentane and heavier hydrocarbons. Natural gas produced from subterranean formations may also contain undesirable components such as carbon dioxide, nitrogen, helium and hydrogen sulfide. The undesirable components are usually removed before the natural gas is used as a fuel.

For example, fluids produced from a conventional hydrocarbon reservoir may be transported to a production facility, such as located on an offshore platform or on land. The produced fluid may be separated by separation apparatus into predominantly water, oil, and gas phases. The gas may be treated using a conventional gas treatment apparatus to remove contaminants such as $CO_2$ and $H_2S$. The treated gas may then be compressed and exported such as by using a compressor. The compressed gas may be introduced into a pipeline or shipped as compressed natural gas in a tanker. Alternatively, the natural gas may be liquefied and shipped by tanker or else converted by a gas-to-liquids process into a liquid product. Alternatively, the treated gas then may be formed in a natural gas hydrate and introduced into a pipeline or shipped in a tanker.

Clathrates are crystalline compounds defined by the inclusion of a "guest" molecule within a solid lattice of a host molecule. Gas clathrates are a subset of clathrate wherein the "guest" molecule is a gas at or near ambient temperatures and pressures. One of the most common varieties of clathrates is that where the host molecule is water. These are referred to as clathrate hydrates (often simply as "hydrates"). Clathrate hydrates are crystalline compounds defined by the inclusion of a guest molecule within a hydrogen bonded water lattice. Quantum physical forces such as van der Waals forces and hydrogen bonding are involved in creating and maintaining these clathrate hydrate structures. Gas hydrates are a subset of clathrate hydrates wherein the "guest" molecule is a gas at or near ambient temperatures and pressures. Such gases include methane, propane, carbon dioxide, hydrogen and many others. Natural gas hydrates (clathrate hydrates of natural gases) form when water and certain low molecular weight hydrocarbon molecules (e.g., those commonly found in "natural gas") are brought together under suitable conditions of relatively high pressure and low temperature. The primary guest molecule in natural gas hydrates is generally methane, but natural gas hydrates can also contain other species such as ethane, propane, etc.

Gas hydrates are defined by four primary physical characteristics: an ability to adsorb large amounts of guest molecules within a hydrogen bonded lattice; an ability to separate gas mixtures based on the preferential formation of one gas hydrate over another; a large latent heat of formation that is similar to that of ice, but dependent on the specific guest molecule and additives; and a formation temperature generally higher than that required to convert water to ice. Under these conditions the 'host' water molecules will form a cage or lattice structure capturing a "guest" gas molecule inside. Large quantities of gas are closely packed together by this mechanism. For example, a cubic meter of methane hydrate contains 0.8 cubic meters of water and up to 172 cubic meters of methane gas. While the most common clathrate on earth is methane hydrate, other gases also form hydrates including hydrocarbon gases such as ethane and propane as well as non-hydrocarbon gases such as $H_2$, $CO_2$ and $H_2S$. While many of the embodiments discusses herein refer to natural gas hydrates, the scope of this disclosure encompasses the transportation and cooling of other gas hydrates, such as those containing $CO_2$, $H_2$, and other low molecular weight hydrocarbons.

Gas hydrates are stable only under specific pressure-temperature conditions. Under the appropriate pressure, they can exist at temperatures significantly above the freezing point of water. The maximum temperature at which gas hydrate can exist depends on pressure and gas composition. For a given composition, the stability region for a gas hydrate can be represented as a region on a two dimensional pressure-temperature phase diagram; the gas hydrate is stable for pressure-temperature values within specified regions of the phase diagram, and unstable outside of these regions. The boundary between regions where the hydrate is and is not stable can be described as a function of pressure versus temperature, or equivalently, as a function of temperature versus pressure. For example, methane plus water at 600 psia forms hydrate at 41° F., while at the same pressure, methane+1% propane forms a gas hydrate at 49° F. Hydrate stability can also be influenced by other factors, such as salinity.

Natural gas hydrate slurry (separate or loosely aggregated hydrate particles which are suspended in a carrier fluid) can be formed by mixing a clathrate hydrate forming natural gas and water at low temperature and high pressure in a manner designed to maximize the surface contact area between the two. Recent published and/or patented art has identified and defined new mechanisms and potential mechanisms by which formation of natural gas hydrates can be made significantly more efficient. Such art includes the use of certain formation catalysts such as surfactants, hydrotropes, H-hydrate promoters, and activated carbon, which increase the efficiency of clathrate hydrate formation as well as various approaches to increase the rate of thermal transfer.

In an embodiment, the flowing natural gas hydrate 234 includes a natural gas hydrate able to flow, capable of flowing, or being flowed through the transportation conduit 220. For example, flowing may include a capability of a liquid or loose particulate solid to move by flow. For example, flowing may be assisted by pumping, gravity, or pressure differential. For example, a flowing natural gas hydrate may include a flowing or flowable natural gas hydrate slurry 238. In an embodiment, the flowing natural gas hydrate includes a natural gas hydrate and a carrier fluid. In an embodiment, the carrier fluid includes water or a flowable hydrocarbon. In an embodiment, the flowing natural gas hydrate includes a flowing clathrate or semi-clathrate composition with $H_2O$ as a host molecule and a natural gas as a guest molecule. In an embodiment, the flowing natural gas hydrate includes a flowing natural gas hydrate slurry. In an embodiment, the flowing natural gas hydrate includes a flowing natural gas hydrate slush. In an embodiment, the flowing natural gas hydrate includes a pumpable natural gas hydrate.

FIG. 2A illustrates an embodiment of the pipeline 130 wherein the cooling conduit 240 is located within the transportation conduit 220, and the wall of the cooling conduit establishes a thermal coupling 242 with the flowing natural gas hydrate 234. FIG. 2B illustrates an embodiment where the cooling conduit abuts the transportation conduit, and the walls of the two conduits are thermally coupled 242 to form a heat transfer surface thermally coupled with the flowing natural gas hydrate. In an embodiment, the cooling conduit may run longitudinally with the transportation conduit, or may be wound around the transportation conduit (not illustrated) such as for example in a spiral. FIG. 2C illustrates an embodiment of the pipeline wherein the cooling conduit and the transportation conduit are spaced apart, and are thermally coupled. In an embodiment of the pipeline, the cooling conduit and the transportation conduit are thermally coupled by a heat transfer structure 260. For example, the heat transfer structure may include a heat plate or continuous heat pipes thermally coupling the heat-transfer fluid and the flowing natural gas hydrate. For example, the heat transfer structure may include a heat plate or continuous heat pipe that may be several feet, or hundreds of feet long, or more.

In an embodiment, the cooling conduit 240 and the transportation conduit 220 are thermally coupled by a highly thermally conductive material (not illustrated). For example, a highly thermally conductive material may include a material having k>75 W/(m.K) at 25° C. In an embodiment, the cooling conduit and the transportation conduit share a common thermally conductive wall portion (not illustrated)

In an embodiment, the heat-transfer fluid 250 includes a flowable solid-liquid phase slurry. In an embodiment, the heat-transfer fluid includes a flowable ice-water slurry. In an embodiment, the heat-transfer fluid includes a flowable hydrocarbon fluid. In an embodiment, the heat-transfer fluid includes water. In an embodiment, the water includes an anti-freeze agent. In an embodiment, the heat-transfer fluid and a carrier fluid of the natural gas hydrate are substantially the same material, e.g., water. In an embodiment, the heat-transfer fluid and a carrier fluid of the natural gas hydrate comprise a common material.

In an embodiment, the target temperature range includes a temperature range predicted to maintain a selected stability of the flowing natural gas hydrate 234 during a transit of a portion of the transportation conduit 220. For example, a transit of a portion of the transportation conduit may include transit between the first geographic location 122 and the second geographic location 124. In an embodiment, the target temperature range includes a temperature range predicted to maintain a decomposition rate of less than 10% of the flowing natural gas hydrate per 1000 km transit of the transportation conduit. In an embodiment, the target temperature range includes a temperature range predicted to maintain a decomposition rate of less than 5% of the flowing natural gas hydrate per 1000 km transit of the transportation conduit. In an embodiment, the target temperature range includes a temperature range predicted to maintain a decomposition rate of less than 1% of the flowing natural gas hydrate per 1000 km transit of the transportation conduit. In an embodiment, the target temperature range includes a temperature range predicted to maintain the flowing natural gas hydrate at least substantially within its hydrate stability range during transit of the portion of the transportation conduit. In an embodiment, the target temperature range includes a temperature range demonstrated to maintain a selected stability of the flowing natural gas hydrate during a transit of a portion of the transportation conduit. In an embodiment, the target temperature range includes a target temperature range (i) lower than the ambient temperature 192 surrounding the transportation conduit and (ii) predicted to maintain a selected stability of the flowing natural gas hydrate. Because the stable temperature range of the flowing natural gas hydrate is generally below the ambient temperature surrounding the transportation conduit, heat will leak from the environment into the flowing natural gas hydrate; the amount of this heat depending in a known fashion on the ambient temperature, the temperature of the flowing natural gas hydrate, and the thermal resistance between the environment and the inside of the transportation conduit. The role of the heat transfer fluid 250 and the cooling conduit 240 is to remove this leaked heat. The removal of heat into the heat transfer fluid occurs by virtue of maintaining the heat transfer fluid at a targeted temperature range below that at which the flowing natural gas hydrate is maintained at a selected stability, such that the heat leak from the transportation conduit into the cooling conduit (determined by their temperature difference and the thermal resistance between them) balances that from the ambient environment into the transportation conduit. The heat input into the heat transfer fluid can be dealt with by a number of methods. In an embodiment it will be actively dissipated into the environment by a heat pump or a refrigerator. In an embodiment it will be absorbed in sensible heat of the heat transfer fluid, leading to a temperature rise of the heat transfer fluid; since this process will become ineffective if the temperature of the heat transfer fluid rises above the thermal stability range of the natural gas hydrate, heat will be actively removed from the heat transfer fluid and dissipated into the environment by heat pumps or refrigerators spaced at locations along the pipeline. In an embodiment, the heat input into the heat transfer fluid is absorbed by a phase change of the heat transfer fluid (for instance melting of solid components of a solid liquid slurry, and/or vaporization of a liquid). This offers two advantages; the temperature of the heat transfer fluid remains constant during the process, and for a given amount of heat transfer fluid, the phase change process generally absorbs more heat than can be done by permissible temperature rises. The required temperature range of the heat transfer fluid can be determined by prediction, based on knowledge of the above parameters. The required temperature range of the heat transfer fluid can be determined empirically by monitoring (for example) the temperature of the flowing natural gas hydrate or of the heat transfer fluid and increasing cooling of the heat transfer fluid if the temperatures are too high relative to the stability range and reducing cooling if they are too low. During operation the amount of cooling required can vary due, for example, to changes in the ambient temperature, changes in the thermal resistance between the environment and the interior of the transportation conduit, or changes in the amount or temperature of the heat transfer fluid.

In an embodiment, the heat-transfer fluid 250 is selected to absorb heat from the flowing natural gas hydrate 234 by undergoing a phase change. For example, the phase change may include melting ice or an ice slurry to water; this can be advantageous since the melting point of ice is generally less than the decomposition temperature of gas hydrates. For example, the phase change may include water contained at a selected low vapor pressure (chosen such that the resultant vaporization temperature is less than a stable temperature of the natural gas hydrate), and evaporating or boiling the water absorbs heat from the flowing natural gas hydrate. In an embodiment, both types of phase changes, melting and vaporization can be utilized. In an embodiment, in an open-cycle system, the water vapor produced by the boiling is discarded by venting or pumping out of the cooling conduit. In an embodiment, in closed-cycle system, the water vapor produced by the boiling is condensed and recycled. In an embodiment, the heat-transfer fluid is maintained at a vapor pressure of less than 1 bar and is selected to achieve a specified $T_{VAP}$ configured to cool the heat-transfer fluid to the target temperature range. In an embodiment, the heat-transfer fluid is selected to absorb heat from the flowing natural gas hydrate by undergoing a phase change from ice-in-an-ice-water slurry to water-in-the-ice-water slurry. In an embodiment, the water-in-the-ice-water slurry may be discarded by pumping out of the cooling conduit in an open-cycle version.

In an embodiment, the pipeline system 110 includes an exhaust system 114 configured to vent a portion of the heat-transfer fluid 250 after the heat-transfer fluid has undergone the phase change. In embodiments where the heat transfer fluid is maintained at a sub-ambient pressure, the exhaust system can comprise a pump in order to raise the pressure of the exhausted gas. In an embodiment, the heat-transfer fluid flows from the first geographical location 122 to the second geographical location 124. In an embodiment, the heat-transfer fluid flows from the second geographical location to the first geographical location.

Figure 11:
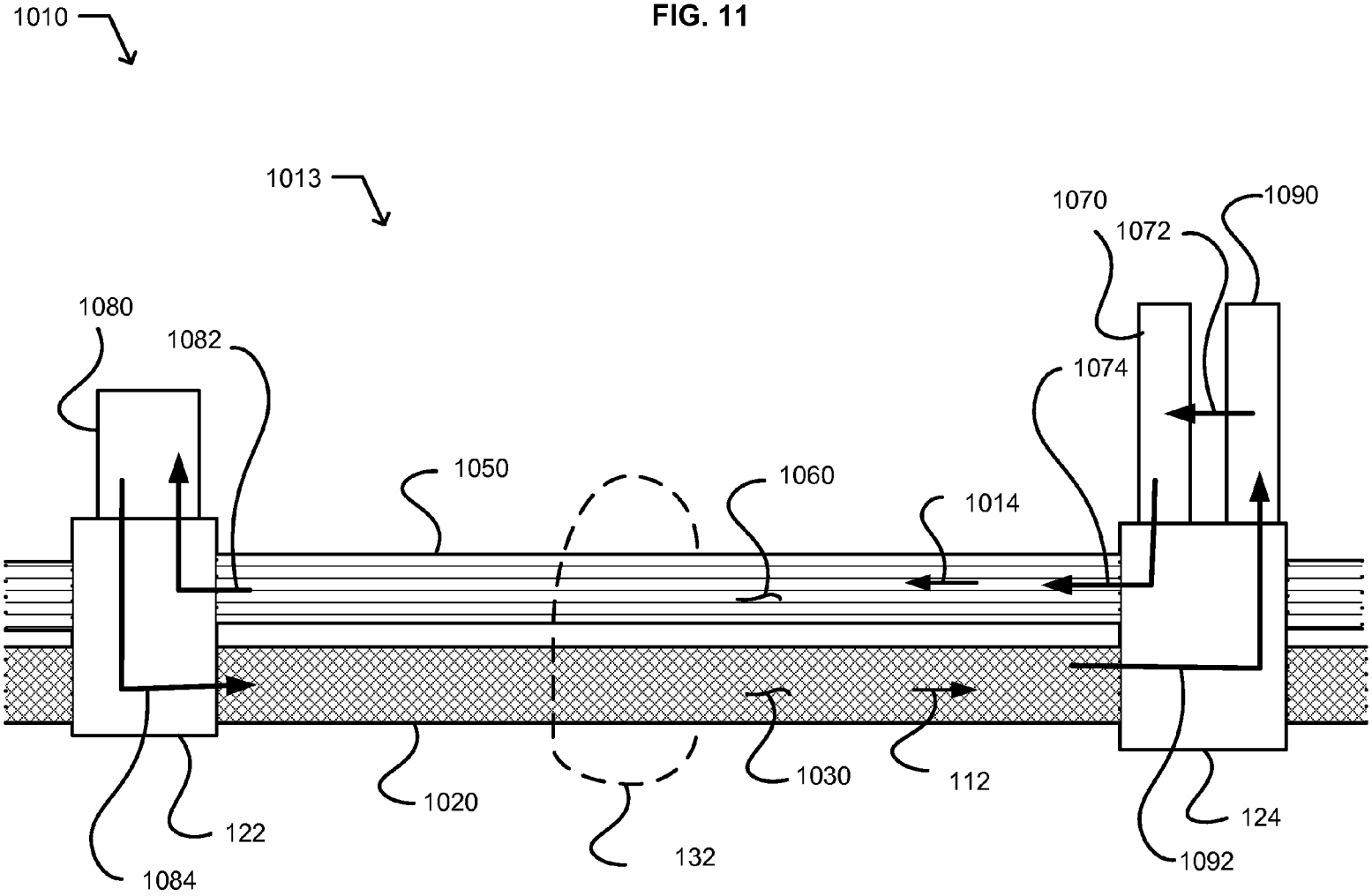
FIG. 11 illustrates an example pipeline system 1010 in which embodiments may be implemented.

In an embodiment, the pipeline system 110 includes a return-conduit running between the second geographical location 124 and the first geographical location 122. In embodiments where the heat transfer fluid flows from the first geographical location 122 to the second geographical location 124, the return-conduit contains a portion of the heat-transfer fluid 250 withdrawn from the cooling conduit 240 at the second geographical location. The withdrawn heat-transfer fluid is flowing from the second geographical location toward the first geographical location. In other embodiments where the heat transfer fluid flows from the second geographical location 124 to the first geographical location 122, heat transfer fluid is withdrawn at the first geographical location and returns it to the second geographical location. These embodiments are not illustrated in FIG. 2. However, FIG. 11 illustrates an embodiment that includes a recovered-liquid conduit 1050 returning a recovered liquid 1060 from the second geographical location toward the first geographical location. The return conduit may or may not be thermally coupled to the flowing natural gas hydrate 234, correspondingly the returning heat transfer fluid may or may not take part in cooling the flowing natural gas hydrate.

Figure 3:
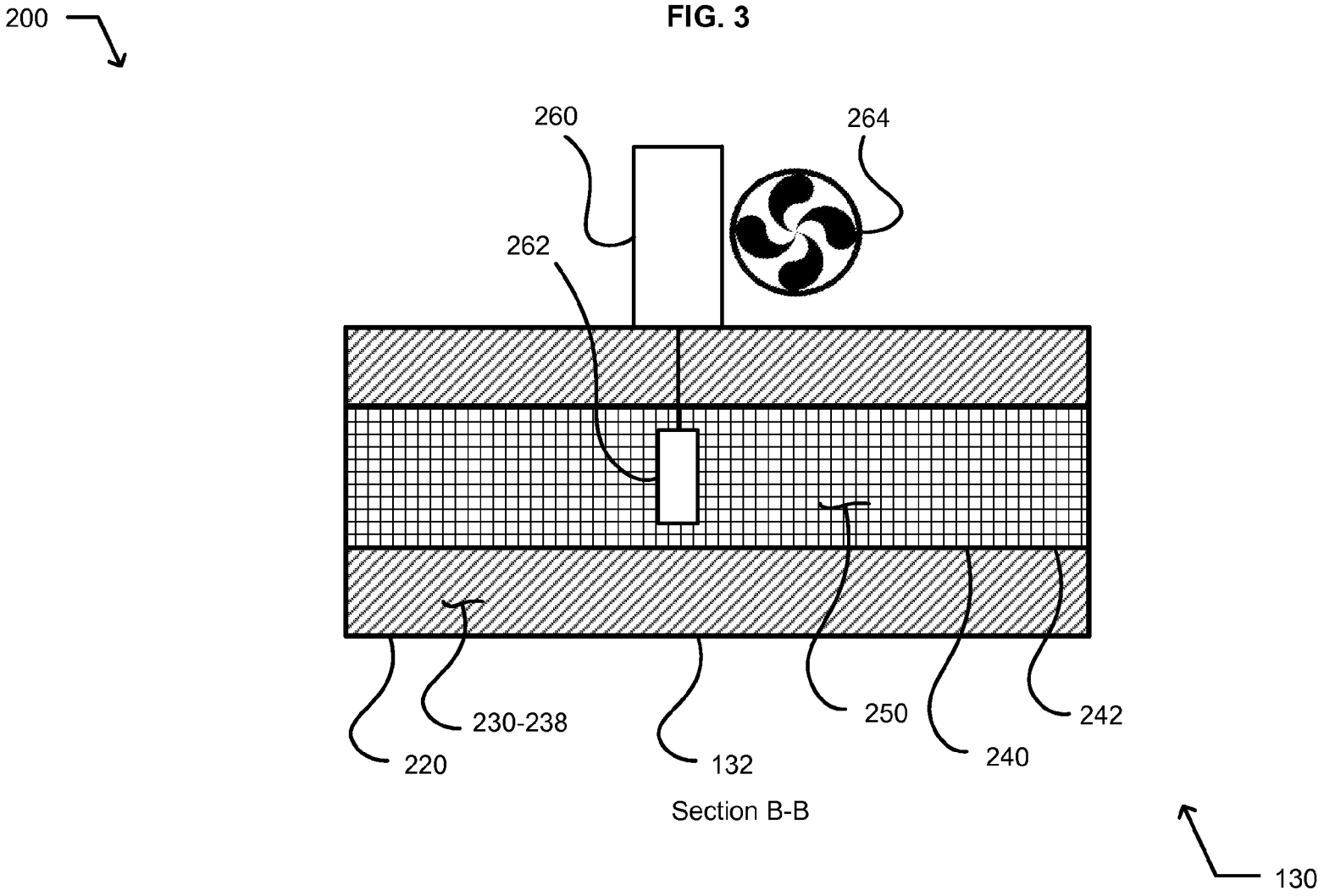
FIG. 3 illustrates an alternative embodiment 200 of the pipeline system 110 and the pipeline 130 illustrated in FIGS. 1-2.

FIG. 3 illustrates an alternative embodiment 200 of the pipeline system 110 and the pipeline 130 illustrated in FIGS. 1-2. FIG. 3 illustrates a longitudinal section view B-B of the segment 132 illustrated in FIG. 2. In this alternative embodiment, the pipeline system further includes a cooling system 260 configured to cool the heat-transfer fluid 250 to the target temperature range. In an embodiment, the cooling system includes an open-cycle cooling system configured to cool the heat-transfer fluid to the target temperature range. In an embodiment, the cooling system includes a closed-cycle refrigeration system configured to cool the heat-transfer fluid to the target temperature range. For example, the closed-cycle refrigeration system may include a single phase, or a phase change based system. In an embodiment, the closed-cycle refrigeration system further includes a closed-cycle refrigeration system configured to cool the heat-transfer fluid to the target temperature range using multiple phase changes. For example, multiple phase changes may include a phase change from a solid to a liquid, and then a phase change from liquid to a gas. For example, the heat-transfer fluid 250 of FIG. 2A may pass through three phases. In an embodiment, the closed-cycle refrigeration system further includes a refrigeration controller (not illustrated) coupled with the closed-cycle refrigeration system and configured to regulate cooling of the heat-transfer fluid by the closed-cycle refrigeration system to achieve the target temperature range of the heat-transfer fluid.

In an embodiment, the closed-cycle cooling system includes an evaporator portion 262 located at a site along the cooling conduit 240 and having a direct or an indirect thermal contact with the heat-transfer fluid 250. In an embodiment, the closed-cycle cooling system includes evaporator portions respective located at a plurality of sites along the cooling conduit, each of the plurality of sites having a direct or an indirect thermal contact with the heat-transfer fluid. In an embodiment, the cooling system is powered at least in part by combustion of natural gas released by decomposition of the flowing natural gas hydrate 234 contained in the transportation conduit. For example, the cooling system may be implemented using absorption refrigeration, or the cooling system may be implemented using electrical power generated by combustion of the released natural gas. In an embodiment, the closed-cycle cooling system includes a condenser portion 264.

Figure 4:
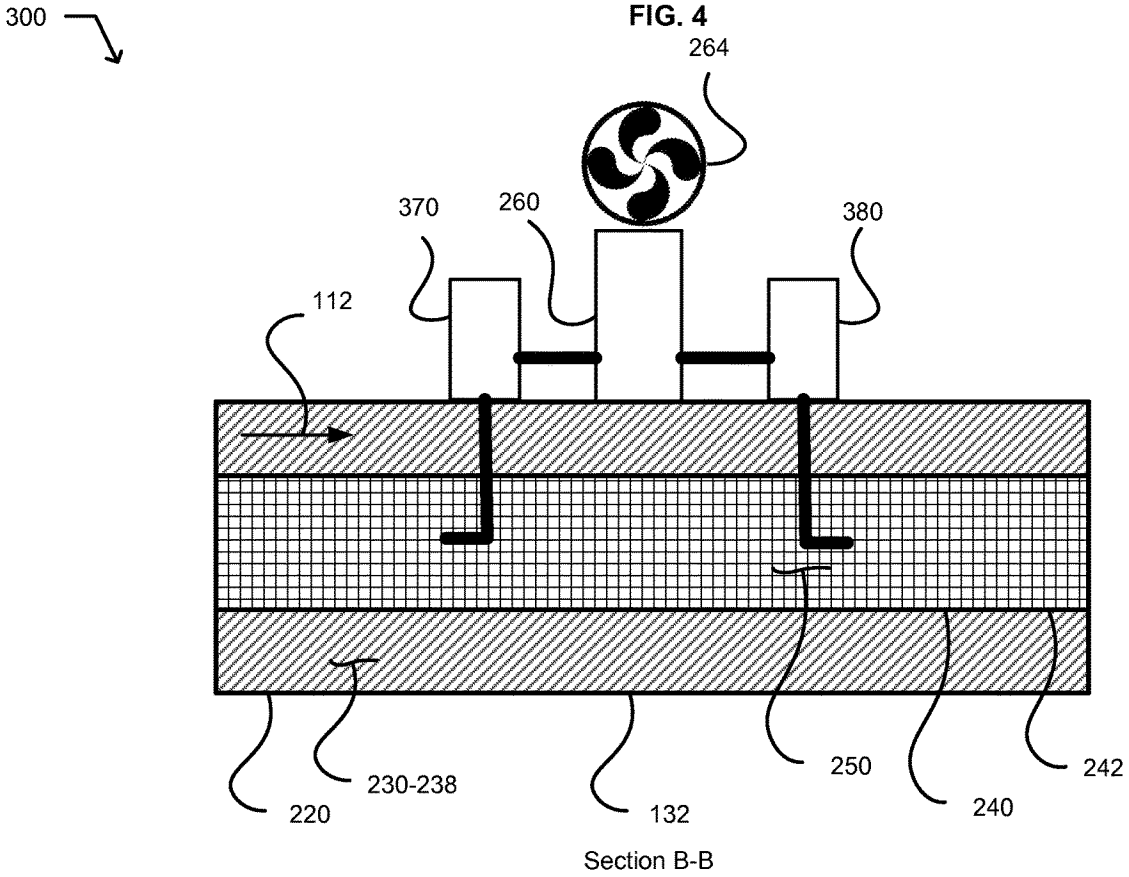
FIG. 4 illustrates an alternative embodiment 300 of the pipeline system 110 and the pipeline 130 illustrated in FIGS. 1-2.

FIG. 4 illustrates an alternative embodiment 300 of the pipeline system 110 and the pipeline 130 illustrated in FIGS. 1-2. FIG. 4 illustrates a longitudinal section view B-B of the segment 132 of the pipeline illustrated in FIG. 2. In this alternative embodiment, the pipeline system further includes a removal system 370 withdrawing at least a portion of the heat-transfer fluid 250 from the cooling conduit 240. The pipeline system further includes an injection system 380 introducing the withdrawn heat-transfer fluid into the cooling conduit after cooling of the withdrawn heat-transfer fluid by the cooling system 260. The injection system 380 may be configured to reintroduce the withdrawn heat transfer fluid into the cooling conduit at a location either downstream, upstream, or proximal to the withdrawal location.

Returning to the environment 200 illustrated in part by FIG. 2, in an embodiment, the pipeline system of 110 includes a hydrate pump 116 urging the flowing natural gas hydrate 234 toward the second geographic location 124. In an embodiment, the hydrate pump includes a pressure controller 118 configured to regulate the pressure of the contained natural gas hydrate flowing between the first geographic location 122 and the second geographic location. The regulated pressure and the target temperature range are predicted to maintain the selected stability of the natural gas hydrate flowing from the first geographic location to the second geographic location. In an embodiment, at least a portion of the cooling conduit 240 has a slope providing a gravitational flow of the heat-transfer fluid 250 either from the first geographical location toward the second geographical location, or from the second geographic location toward the first geographical location. In an embodiment, at least a portion of the cooling conduit includes a capillary member (not illustrated) configured to provide the flow of the heat-transfer fluid either from the first geographical location toward the second geographical location, or from the second geographical location toward the first geographical location. In an embodiment, the pipeline system includes a fluid pump 117 urging the flowing of the heat-transfer fluid from the first geographical location toward the second geographical location, or from the second geographical location toward the first geographical location. In an embodiment, the pipeline system includes an insulating material (not illustrated) thermally separating the transportation conduit from the ambient temperature 192 of the environment 100 surrounding the transportation conduit. For example, the insulating material may include earthen material burying the transportation conduit, or insulation thermally separating the transportation conduit from the environment, such as foam, aerogel, or multi-layer insulation. In an embodiment, the pipeline system includes a temperature sensor not illustrated) responsive to a temperature of the natural gas hydrate. In an embodiment, the pipeline system includes a temperature sensor responsive to a temperature of the heat-transfer fluid. In an embodiment, the pipeline system includes a pressure sensor 119 responsive to a pressure of the natural gas hydrate. In an embodiment, the pipeline system includes a pressure sensor responsive to a pressure of the heat-transfer fluid. In an embodiment, the pipeline system includes a controller (not illustrated) configured to control a pressure or temperature of the heat-transfer fluid.

FIGS. 2-4 illustrate an alternative embodiment of the pipeline system 110. In this alternative embodiment, the pipeline system includes the transportation conduit 220 configured to contain the natural gas hydrate 234 flowing 112 from the first geographic location 122 to the second geographic location 124. The pipeline system includes the cooling conduit 240 running parallel to the transportation conduit, having a heat-transfer surface 242 thermally coupled with the natural gas hydrate contained within the transportation conduit, and configured to contain the heat-transfer fluid 250 flowing between the first geographic location and the second geographic location. The pipeline system includes the cooling system 260 configured to cool the heat-transfer fluid to a target temperature range predicted to maintain a selected stability of the natural gas hydrate contained by and flowing through the transportation conduit. In an embodiment, the pipeline system includes the removal system 370 configured to withdraw at least a portion of the heat-transfer fluid from the cooling conduit. The pipeline system also includes the injection system 380 configured to introduce the withdrawn heat-transfer fluid into the cooling conduit after cooling of the withdrawn heat-transfer fluid by the cooling system 260. In an embodiment, the pipeline system includes the hydrate pump (not illustrated) configured to urge the flow of the natural gas hydrate toward the second geographic location. In an embodiment, the pipeline system includes a fluid pump (not illustrated) configured to urge the flow of the heat-transfer fluid toward the second geographical location, or toward the first geographical location.

FIGS. 2-4 illustrate another alternative embodiment of the pipeline system 110. In this alternative embodiment, the pipeline system includes the transportation conduit 220 configured to contain a gas clathrate 230 flowing 112 from the first geographical location 122 to the second geographical location 124. The pipeline system includes the cooling conduit 240 running parallel to the transportation conduit, having a heat-transfer surface 242 thermally coupled with the flowing gas clathrate, and containing the flowing heat-transfer fluid 250. The flowing heat-transfer fluid has a target temperature range predicted to maintain a selected stability of the gas clathrate flowing from the first geographical location to the second geographical location. In an embodiment, the gas clathrate includes the gas hydrate 232. In an embodiment, the gas hydrate includes the natural gas hydrate 234. In an embodiment, the gas hydrate includes a $CO_2$ hydrate 236. For example, the $CO_2$ hydrate may be bound for sequestration.

In an embodiment of the another alternative embodiment, the pipeline system 110 includes the cooling system 260 configured to cool the heat-transfer fluid to the target temperature range. In an embodiment, the pipeline system includes a pump system (not illustrated) configured to urge the flowing gas clathrate from the first geographical location to the second geographical location. In an embodiment, the pipeline system includes a pump system (not illustrated) configured to urge the flowing heat-transfer fluid from the first geographical location toward the second geographical location, or from the second geographical location toward the first geographical location.

FIGS. 2-4 illustrate a further alternative embodiment of the pipeline system 110. In this further alternative embodiment, the pipeline system includes the transportation conduit 220 configured to contain the gas clathrate 230 flowing from the first geographic location 122 to the second geographic location 124. The pipeline system includes the cooling conduit 240 running parallel to the transportation conduit, having a heat-transfer surface 242 thermally coupled with gas clathrate contained within the transportation conduit, and configured to contain a heat-transfer fluid flowing between the first geographic location and the second geographic location. The pipeline system includes the cooling system 260 configured to cool the heat-transfer fluid to a target temperature range predicted to maintain a selected stability of the gas clathrate contained by and flowing through the transportation conduit. In an embodiment, the gas clathrate includes a gas hydrate 232. In an embodiment, the gas hydrate includes the natural gas hydrate 234. In an embodiment, the gas hydrate includes a $CO_2$ hydrate 236.

In an embodiment of this further alternative embodiment, the pipeline system 110 includes the cooling system 260 configured to cool the heat-transfer fluid 250 to the target temperature range. In an embodiment, the pipeline system includes a pump system (not illustrated) configured to urge the flowing gas clathrate from the first geographical location 122 to the second geographical location 124. In an embodiment, the pipeline system includes a pump system (not illustrated) configured to urge the flowing heat-transfer fluid from the first geographical location toward the second geographical location, or from the second geographical location toward the first geographical location.

FIGS. 2-4 illustrate another alternative embodiment of the pipeline system 110. In this alternative embodiment, the pipeline system includes the transportation conduit 220 configured to contain a gas clathrate 230 flowing from the first geographic location 122 to the second geographic location 124. The pipeline system includes the cooling conduit 240 running parallel to the transportation conduit, having a heat-transfer surface 242 thermally coupled with gas clathrate contained within the transportation conduit, and configured to contain a heat-transfer fluid flowing between the first geographic location and the second geographic location. The pipeline system includes a cooling system configured to cool the heat-transfer fluid to a target temperature range predicted to maintain a selected stability of gas clathrate contained by and flowing through the transportation conduit.

In an embodiment of this another alternative embodiment, the gas clathrate 230 includes a gas hydrate 232. In an embodiment, the gas hydrate includes the natural gas hydrate 234. In an embodiment, the gas hydrate includes a $CO_2$ hydrate 236.

Figure 5:
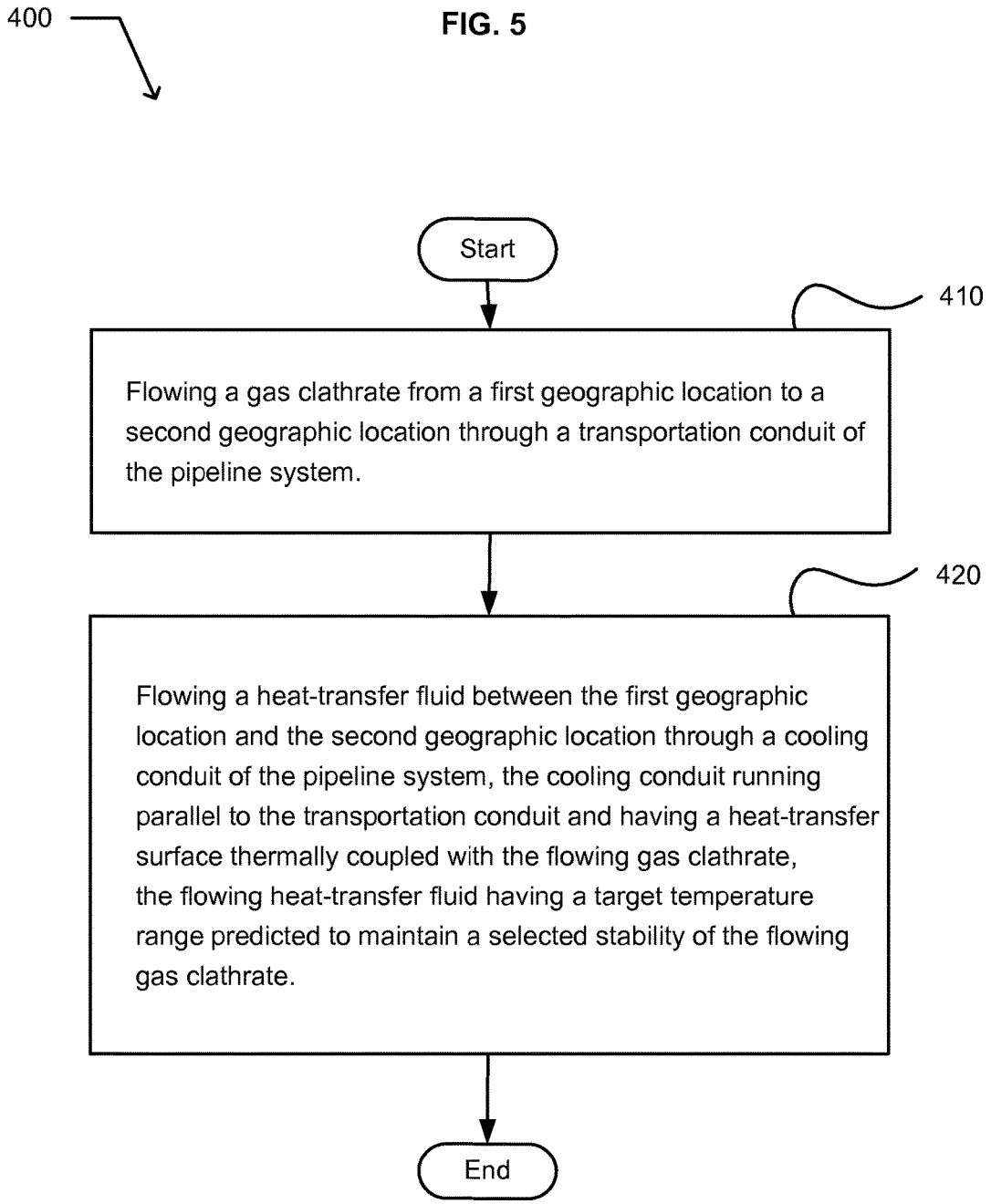
FIG. 5 illustrates an example operational flow 400 implemented in a pipeline system.

FIG. 5 illustrates an example operational flow 400 implemented in a pipeline system. After a start operation, the operational flow includes a fluid transport 410 operation. The fluid transport operation includes flowing a gas clathrate from a first geographic location to a second geographic location through a transportation conduit of the pipeline system. In an embodiment, the fluid transport operation may be implemented in part or in whole using the transportation conduit 220 described in conjunction with FIG. 2. A clathrate stability control operation 420 includes flowing a heat-transfer fluid between the first geographic location and the second geographic location through a cooling conduit of the pipeline system. The cooling conduit running parallel to the transportation conduit and having a heat-transfer surface thermally coupled with the flowing gas clathrate. The flowing heat-transfer fluid has a target temperature range predicted to maintain a selected stability of the flowing gas clathrate. In an embodiment, the clathrate stability control operation may be implemented in part or in whole using the cooling conduit 240 described in conjunction with FIG. 2. The operational flow includes an end operation. In an embodiment, the gas clathrate includes a gas hydrate 232. In an embodiment, the gas hydrate includes the natural gas hydrate 234. In an embodiment, the gas hydrate includes a $CO_2$ hydrate 236.

Figure 6:
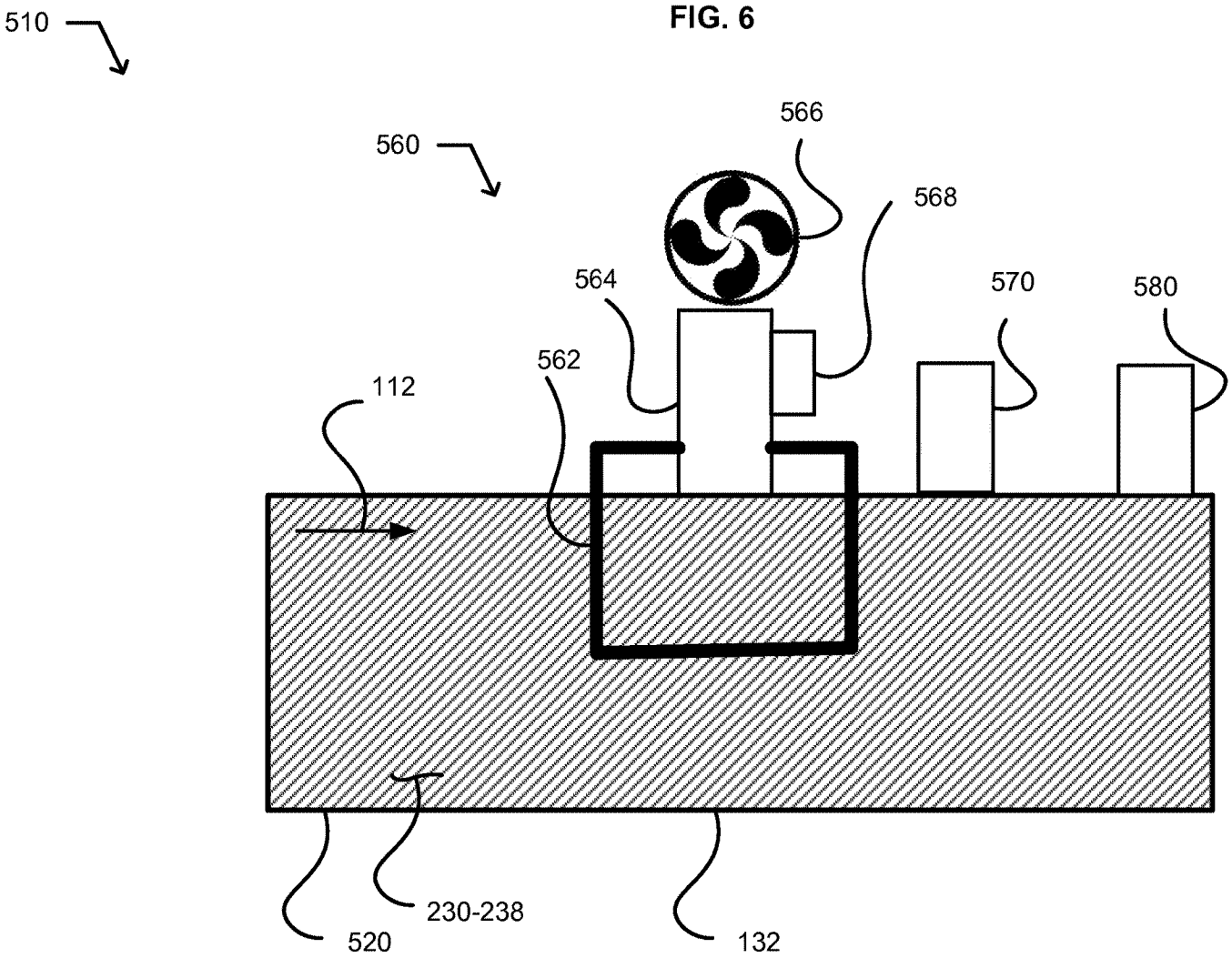
FIG. 6 illustrates an example embodiment of a pipeline system 510 in which embodiments may be implemented.

FIG. 6 illustrates an example embodiment of a pipeline system 510. The pipeline system includes a transportation conduit 520 containing the gas hydrate 232 flowing from the first geographical location 122 to the second geographical location 124. The pipeline system includes a cooling system 560 in thermal contact with the flowing gas hydrate and maintaining the temperature of the flowing gas hydrate within a target temperature range predicted to maintain a selected stability of the flowing gas hydrate. In an embodiment, the gas hydrate 232 includes a natural gas hydrate 234. In an embodiment, the gas hydrate includes the $CO_2$ gas hydrate 236. In an embodiment, the gas hydrate includes a $CO_2$ gas hydrate and a natural gas hydrate.

In an embodiment, the transportation conduit 520 contains the flowing gas hydrate 232 at a low pressure. In an embodiment, the transportation conduit contains the flowing gas hydrate at a pressure less than about 50 bars. In an embodiment, the transportation conduit contains the flowing gas hydrate at a pressure less than about 20 bars. In an embodiment, the transportation conduit contains the flowing gas hydrate at a pressure less than about 10 bars. In an embodiment, the transportation conduit contains the flowing gas hydrate at a pressure less than about 5 bars.

In an embodiment, the transportation conduit 520 includes a metal or plastic material. In an embodiment, the cooling system 560 includes an evaporator portion 562 in thermal contact with the flowing gas hydrate 232. In an embodiment, the evaporator portion is located within the transportation conduit and in direct thermal contact the flowing gas hydrate, e.g., separated only by a heat transfer surface of the evaporator portion. In an embodiment, the evaporator portion has an indirect thermal contact the flowing gas hydrate (not illustrated); for example they may be thermally coupled by a conductive member, by a heat pipe, by a second coolant loop, etc. In an embodiment, at least a portion of a wall of the transportation conduit is disposed between the flowing gas hydrate and the evaporator portion of the cooling system (not illustrated). In an embodiment, the at least a portion of the wall of the transportation conduit has a thermally conductivity of k>30 W/(m.K). For example, carbon steel has a thermal conductivity k of 54 at 25° C., and pure aluminum has a thermal conductivity k of 250 at 25° C. In an embodiment, the at least a portion of the wall of the transportation conduit has a thermally conductivity of k>70 W/(m.K).

In an embodiment, the evaporator portion 562 of the cooling system 560 is positioned at a potential hot spot of the transportation conduit 520. In an embodiment, the cooling system includes at least two cooling systems. In an embodiment, the at least two cooling systems are spaced-apart along a length of the transportation conduit. In an embodiment, the cooling system includes a condenser 566.

In an embodiment, the cooling system 560 includes an open loop cooling system. In an embodiment, the cooling system includes a closed-cycle cooling system. In an embodiment, the closed-cycle cooling system includes a refrigeration system 564. In an embodiment, the refrigeration system is powered by combustion of natural gas released by decomposition of the flowing natural gas hydrate. In an embodiment, the decomposition of the flowing natural gas hydrate occurs in a normal course of transportation through the transportation conduit. In an embodiment, the decomposition of the flowing natural gas hydrate occurring by an intentional withdrawal and decomposition from the flowing natural gas hydrate. In an embodiment, the closed-cycle cooling system includes a passive closed-cycle cooling system. For example, a passive closed-cycle cooling system may include a heat pipe or a heat plate. In an embodiment, the passive closed-cycle cooling system includes a single phase closed-cycle cooling system. In an embodiment, the passive closed-cycle cooling system includes a two phase closed-cycle cooling system.

In an embodiment, the pipeline system 510 includes a pump system (not illustrated) urging the flowing gas hydrate 234 through at least the portion of the transportation conduit. In an embodiment, the pump system is powered by combustion of natural gas decomposed from the flowing natural gas hydrate transported in the transportation conduit. See decomposition unit 570. In an embodiment, the pipeline system includes a pressure sensor (not shown) responsive to a pressure of the flowing gas hydrate or of the heat transfer fluid. In an embodiment, the pipeline system includes a temperature sensor (not shown) responsive to a temperature of the flowing gas hydrate, and/or a temperature of the heat transfer fluid. In an embodiment, the pipeline system includes a controller 580 configured to control a pressure or temperature of the flowing gas hydrate in response to a sensed pressure or temperature of the flowing gas hydrate or of the heat transfer fluid.

FIG. 6 illustrates an alternative embodiment of the pipeline system 510. In the alternative embodiment, the pipeline system includes a transportation conduit 520 configured to contain the natural gas hydrate 234 flowing from the first geographic location 122 to the second geographic location 124. The pipeline system includes the cooling system 560 configured to cool the contained and flowing natural gas hydrate to a target temperature range predicted to maintain a selected stability of the flowing natural gas hydrate. In an embodiment, the cooling system is configured to be powered by combustion of natural gas released by decomposition of the contained flowing natural gas hydrate through the transportation conduit.

In an embodiment of this alternative embodiment, the pipeline system 510 includes a cooling system controller 568 coupled with the cooling system 560 and configured to regulate cooling of the flowable natural gas hydrate 234 by the cooling system. In an embodiment, the cooling system controller is configured to regulate cooling by the cooling system to achieve a target temperature range of the flowable natural gas hydrate predicted to maintain a selected stability of the flowable natural gas hydrate. In an embodiment, the target temperature range includes a target temperature range of the flowable natural gas hydrate (i) lower than the ambient temperature 192 surrounding the transportation conduit and (ii) predicted to maintain a selected stability of the flowing natural gas hydrate. Because the stable temperature range of the flowing natural gas hydrate is generally below the ambient temperature surrounding the transportation conduit, heat will leak from the environment into the flowing natural gas hydrate; the amount of this heat depending in a known fashion on the ambient temperature, the temperature of the flowing natural gas hydrate, and the thermal resistance between the environment and the inside of the transportation conduit. The role of the cooling system is to remove this leaked heat. The amount of cooling required can be determined by prediction, based on knowledge of the above parameters. The amount of cooling required can be determined empirically by monitoring (for example) the temperature of the flowing natural gas hydrate and increasing cooling if it is too high relative to the target temperature range and reducing cooling if it is too low. During operation the amount of cooling required can vary due, for example, to changes in the ambient temperature, or changes in the thermal resistance between the environment and the interior of the transportation conduit. In an embodiment, the target temperature range is responsive to the stability temperature and pressure range profile of the particular natural gas hydrate being transported in the transportation conduit. For example, the stability temperature and pressure range profile for a particular natural gas hydrate may be about 15 degrees C. at one atmospheric pressure. For example, the stability temperature and pressure range profile for a particular natural gas hydrate may also be a function of its particular chemical additives. In an embodiment, the cooling system controller is configured to regulate cooling by the cooling system of the flowable natural gas hydrate during transport of the flowable natural gas hydrate through a portion of the transportation conduit.

In an embodiment of this alternative embodiment, the pipeline system 510 includes a pressure controller 580 configured to regulate pressure of the flowable natural gas hydrate 234 contained within the portion of the transportation conduit 520. In an embodiment, the pipeline system includes an insulating material (not illustrated) thermally separating the transportation conduit from the ambient temperature 192 surrounding the transportation conduit of the pipeline system. In an embodiment, the pipeline system includes a pumping system (not illustrated) configured to urge the flowable natural gas hydrate through at least the portion of the transportation conduit. In an embodiment, the pipeline system includes a pumping system (not illustrated) configured to be powered by combustion of natural gas decomposed from the flowing natural gas hydrate being transported in the transportation conduit. In an embodiment, the pipeline system includes a pressure sensor (not illustrated) responsive to a pressure of the flowable gas hydrate. In an embodiment, the pipeline system includes a temperature sensor (not illustrated) responsive to a temperature of the flowable gas hydrate.

FIG. 7 illustrates an example operational flow 600 implemented in a pipeline transportation system. After a start operation, the operational flow includes a fluid transport operation 610. The fluid transport operation includes flowing a natural gas hydrate from a first geographical location to another geographical location through a transportation conduit of the pipeline system. In an embodiment, the fluid transport operation may be implemented in part or in whole using the transportation conduit 520 described in conjunction with FIG. 6. A hydrate stability control operation 620 includes withdrawing sufficient heat from the flowing natural gas hydrate to maintain the flowing natural gas hydrate within a target temperature range predicted to maintain a selected stability of the flowing natural gas hydrate. In an embodiment, the hydrate stability control operation may be implemented in part or in whole using the cooling system 560 described in conjunction with FIG. 6. The operational flow includes an end operation.

In an embodiment, the hydrate stability control operation 620 may include at least one additional operation, such as an operation 622, an operation 624, or an operation 626. The operation 622 includes withdrawing sufficient heat from the flowing natural gas hydrate using an evaporator immersed in the flowing natural gas hydrate. The operation 624 includes withdrawing sufficient heat from the flowing natural gas hydrate using a passive cooling system. The operation 626 includes withdrawing sufficient heat from the flowing natural gas hydrate using an active cooling system. In an embodiment, the operational flow 600 may include at least one additional operation, such as an operation 630. The operation 630 includes controlling the withdrawing of sufficient heat at least partially based on a sensed temperature of the flowing natural gas hydrate.

Figure 8:
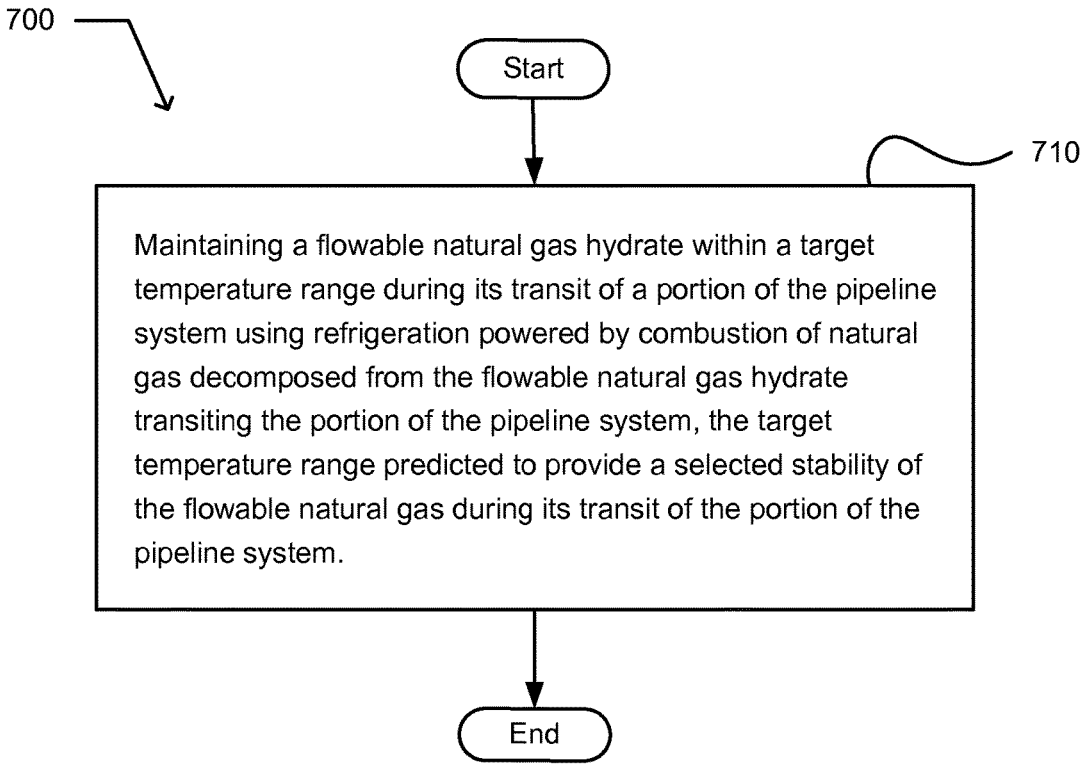
FIG. 8 illustrates an example operational flow 700 implemented in a pipeline transportation system.

FIG. 8 illustrates an example operational flow 700 implemented in a pipeline transportation system. After a start operation, the operational flow includes a temperature controlled hydrate flow operation 710. The temperature controlled hydrate flow operation includes maintaining a flowable natural gas hydrate within a target temperature range during its transit of a portion of the pipeline system using refrigeration powered by combustion of natural gas decomposed from the flowable natural gas hydrate transiting the portion of the pipeline system. The target temperature range is predicted to provide a selected stability of the flowable natural gas during its transit of the portion of the pipeline system. In an embodiment, the temperature controlled hydrate flow operation may be implemented in part or in whole using the pipeline system 510 described in conjunction with FIG. 6. The operational flow includes an end operation.

In an embodiment, the refrigeration is powered at least in part by combustion of natural gas released by decomposition of the flowable natural gas hydrate occurring in the normal course of transiting the portion of the pipeline system. In an embodiment, the refrigeration is powered at least in part by combustion of natural gas intentionally withdrawn and decomposed from the natural gas hydrate transiting the portion of the pipeline system. In an embodiment, the target temperature range provides a selected flowability of the natural gas hydrate. The target temperature range is selected at least partially based on the stability temperature and pressure phase relationship of the particular natural gas hydrate transiting the portion of the pipeline system. In an embodiment, the target temperature range is effective to maintain a selected stability of the flowing natural gas hydrate during its transit of a portion of the pipeline system.

Figure 9:
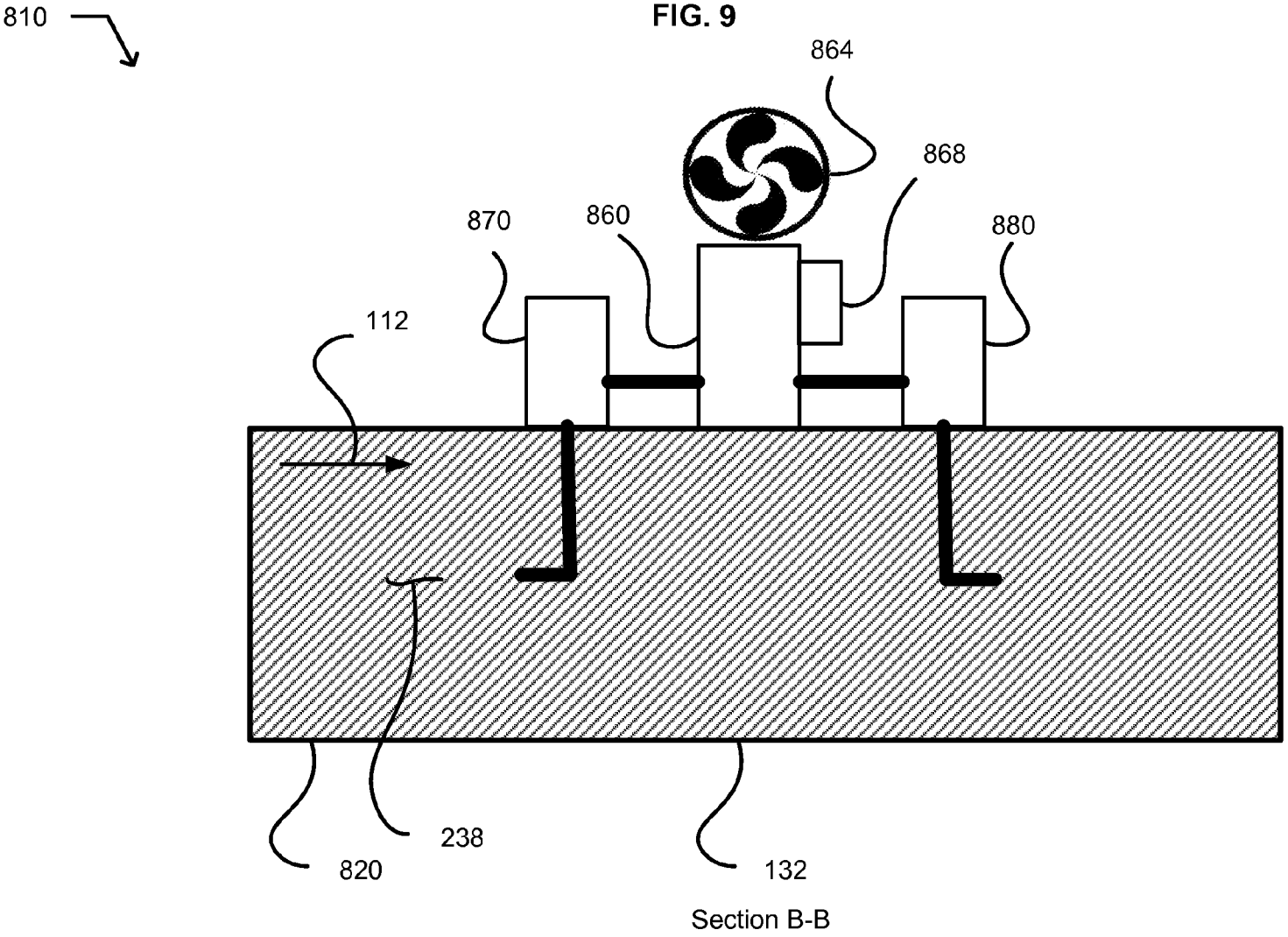
FIG. 9 illustrates an example embodiment of a pipeline system 810 that transports flowable natural gas hydrate slurries.

FIG. 9 illustrates an example embodiment of a pipeline system 810 that transports flowable natural gas hydrate slurries. The pipeline system includes a transportation conduit 820 configured to contain a natural gas hydrate slurry 238 flowing 112 from a first geographic location to a second geographic location, such as the first geographic location 122 and the second geographic location 124 illustrated in FIG. 1. The natural gas hydrate slurry includes a natural gas hydrate and a liquid. The pipeline system includes a removal system 870 configured to withdraw a portion of the liquid from the flowing natural gas hydrate slurry. The pipeline system includes a cooling system 860 configured to cool the withdrawn liquid to a target temperature range. The target temperature range is predicted to provide a selected stability of the natural gas slurry during transit of the natural gas slurry over at least a portion of the distance from the first geographic location to the second geographic location. The pipeline includes a mixing system 880 configured to reintroduce the cooled withdrawn liquid into the flowing natural gas slurry.

In an embodiment, the removal system 870 is located between the first geographical location 122 and the second geographical location 124. In an embodiment, the removal system is configured to separate and withdraw the liquid from the flowing natural gas hydrate slurry. In an embodiment, the cooling system 860 includes an open-cycle cooling system or a closed-cycle cooling system. In an embodiment, the cooling system includes an evaporator (not illustrated). In an embodiment, the cooling system includes a condenser 864. In an embodiment, the cooling system includes a controller 868 coupled with the cooling system and regulating cooling of the withdrawn liquid by the cooling system to achieve the target temperature range. In an embodiment, the cooling system is powered by combustion of natural gas decomposed from the flowing natural gas hydrate slurry. In an embodiment, the removal system 870 or the mixing system 880 is powered by combustion of natural gas decomposed from the natural gas hydrate slurry. In an embodiment, the mixing system is configured to reintroduce and mix the cooled withdrawn liquid into the flowing natural gas hydrate slurry.

Figure 10:
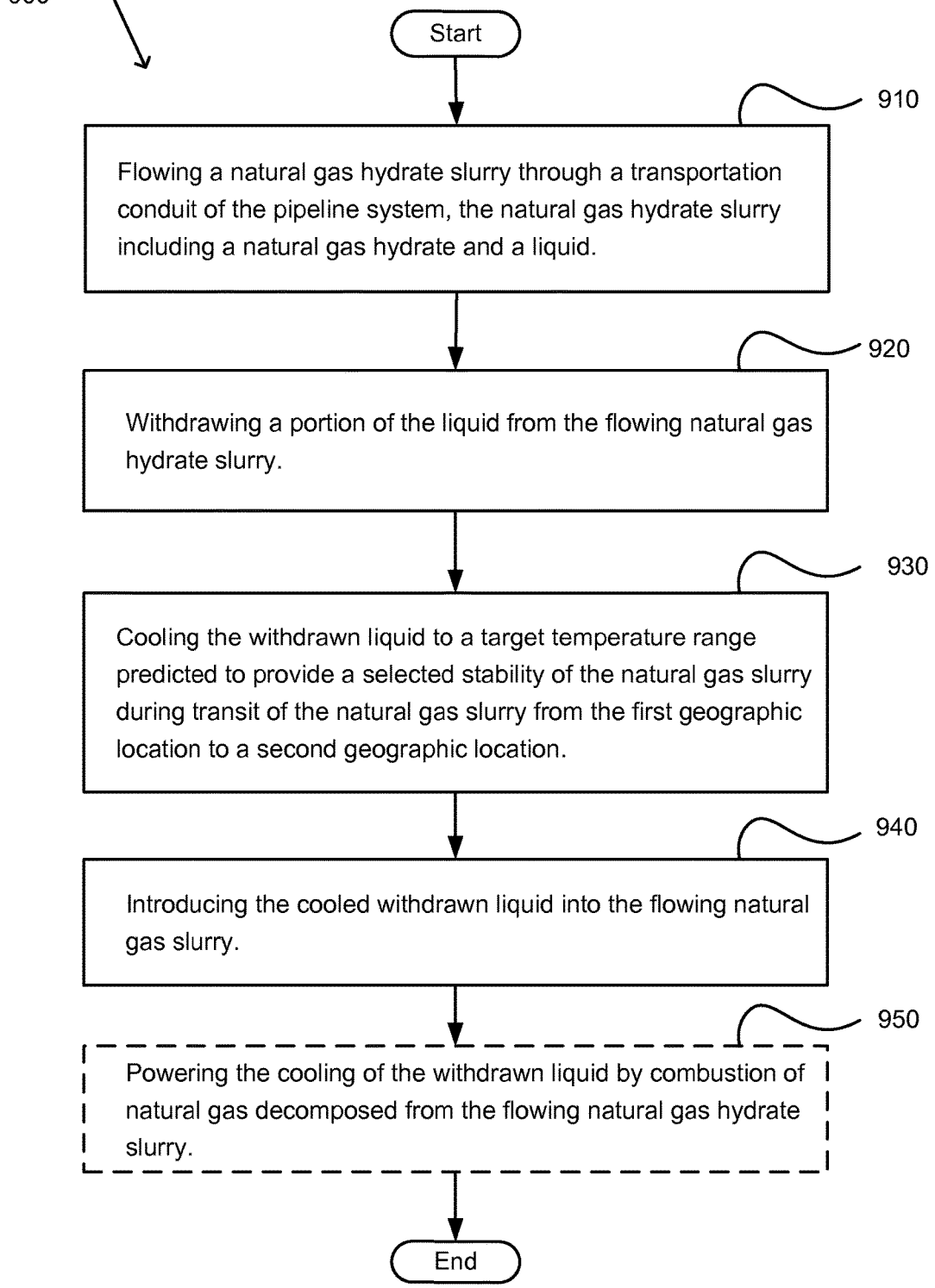
FIG. 10 illustrates an example operational flow 900 implemented in a pipeline system that transports flowable natural gas hydrate slurries from a first geographical location and a second geographical location.

FIG. 10 illustrates an example operational flow 900 implemented in a pipeline system that transports flowable natural gas hydrate slurries from a first geographical location to the second geographical location. After a start operation, the operational flow includes a fluid transport operation 910. The fluid transport operation includes flowing a natural gas hydrate slurry through a transportation conduit of the pipeline system. The natural gas hydrate slurry including a natural gas hydrate and a liquid. In an embodiment, the fluid transport operation may be implemented in part or in whole using the transportation conduit 820 described in conjunction with FIG. 9. An extraction operation 920 includes withdrawing a portion of the liquid from the flowing natural gas hydrate slurry. In an embodiment, the extraction operation may be implemented in part or in whole using the removal system 870 described in conjunction with FIG. 9. A chilling operation 930 includes cooling the withdrawn liquid to a target temperature range predicted to provide a selected stability of the natural gas slurry during transit of the natural gas slurry from the first geographic location to the second geographic location. In an embodiment, the chilling operation may be implemented in part or in whole using the cooling system 860 described in conjunction with FIG. 9. An additive operation 940 includes introducing the cooled withdrawn liquid into the flowing natural gas slurry. In an embodiment, the additive operation may be implemented in part or in whole using the mixing system 880 described in conjunction with FIG. 9. The operational flow includes an end operation.

In an embodiment, the operational flow 900 may include at least one additional operation, such as an operation 950. The operation 950 includes powering the cooling of the withdrawn liquid by combustion of natural gas decomposed from the flowing natural gas hydrate slurry.

FIG. 11 illustrates an example pipeline system 1010. The pipeline system 1010 includes the pipeline 1013, and illustrates an alternative embodiment of the segment 132 running between the first geographic location 122 and the second geographic location 124. The pipeline includes a transportation conduit 1020 configured to contain and flow 112 natural gas hydrate slurry 1030 from the first geographical location 122 to the second geographical location 124. The pipeline system includes a decomposition system 1090 located at the second geographical location and configured to decompose at least a portion of the flowed natural gas hydrate slurry. For example, the decomposition system may be associated with a facility removing natural gas from the hydrate slurry and transmitting removed natural gas to residential and commercial users for consumption. For example, flow arrow 1092 illustrates the decomposition unit receiving natural gas hydrate slurry from the transportation conduit 1020. The pipeline system includes a reclamation system 1070 located at the second geographical location and configured to recover at least a portion of a liquid component released from the decomposed natural gas hydrate slurry. For example, flow arrow 1072 illustrates the reclamation system recovering at least a portion of a liquid component released from the decomposed natural gas hydrate slurry. For example, flow arrow 1074 illustrates the reclamation system introducing the recovered liquid component 1060 into the recovered-liquid conduit. The pipeline includes a recovered-liquid conduit 1050 configured to contain and flow 1014 the recovered liquid component 1060 from the second geographical location toward the first geographical location. The pipeline system includes a combiner system 1080 configured to introduce the recovered liquid component into natural gas hydrate slurry subsequently flowing through the transportation conduit toward the second geographical location from the first geographical location. For example, flow arrow 1084 illustrates the combiner system introducing the recovered liquid component into natural gas hydrate slurry subsequently flowing through the transportation conduit.

In an embodiment, the reclamation system 1070 is configured to separate and recover at least a portion of a liquid component from the decomposed natural gas hydrate slurry. In an embodiment, the reclamation system is configured to recover at least a portion of a liquid component from the flowing natural gas hydrate slurry and recover a liquid product released by decomposition of the natural gas hydrate slurry. In an embodiment, the combiner system 1080 is further configured to receive the recovered liquid component 1060 from the recovered-liquid conduit. For example, arrow 1082 illustrates the combiner system receiving at least a portion of the recovered liquid component from the recovered-liquid conduit. In an embodiment, the combiner system is located at the first geographical location 122. In an embodiment, the combiner system is located at point (not illustrated) between the first geographical location 122 and the second geographical location 124. In an embodiment, the combiner system is located at point (not illustrated)

upstream of the flow 112 from the first geographical location. In an embodiment, the pipeline system includes an injection system (not illustrated) configured to introduce the recovered liquid (illustrated by flow arrow 1074) into t recovered-liquid conduit. In an embodiment (not illustrated) at least a portion of the liquid portion of the natural gas hydrate slurry is recovered at location 124 and returned through a second recovered liquid conduit to location 122, where it may be combined with natural gas hydrate to form natural gas hydrate slurry thereupon sent via the transportation conduit 1020 from location 122 to location 124. In an embodiment, both the liquid product released by decomposition of the natural gas hydrate and the liquid portion of the natural gas hydrate slurry are returned from location 124 to location 122 in separate recovered liquid conduits. In another embodiment, both these liquids are substantially the same composition (e.g., water), and are returned in the same conduit, i.e., the recovered liquid conduit and the second recovered liquid conduit are the same. In another embodiment, the recovered liquid is used as the heat transfer fluid, in which case the recovered liquid conduit 1060 functions as the cooling conduit 240.

Figure 12:
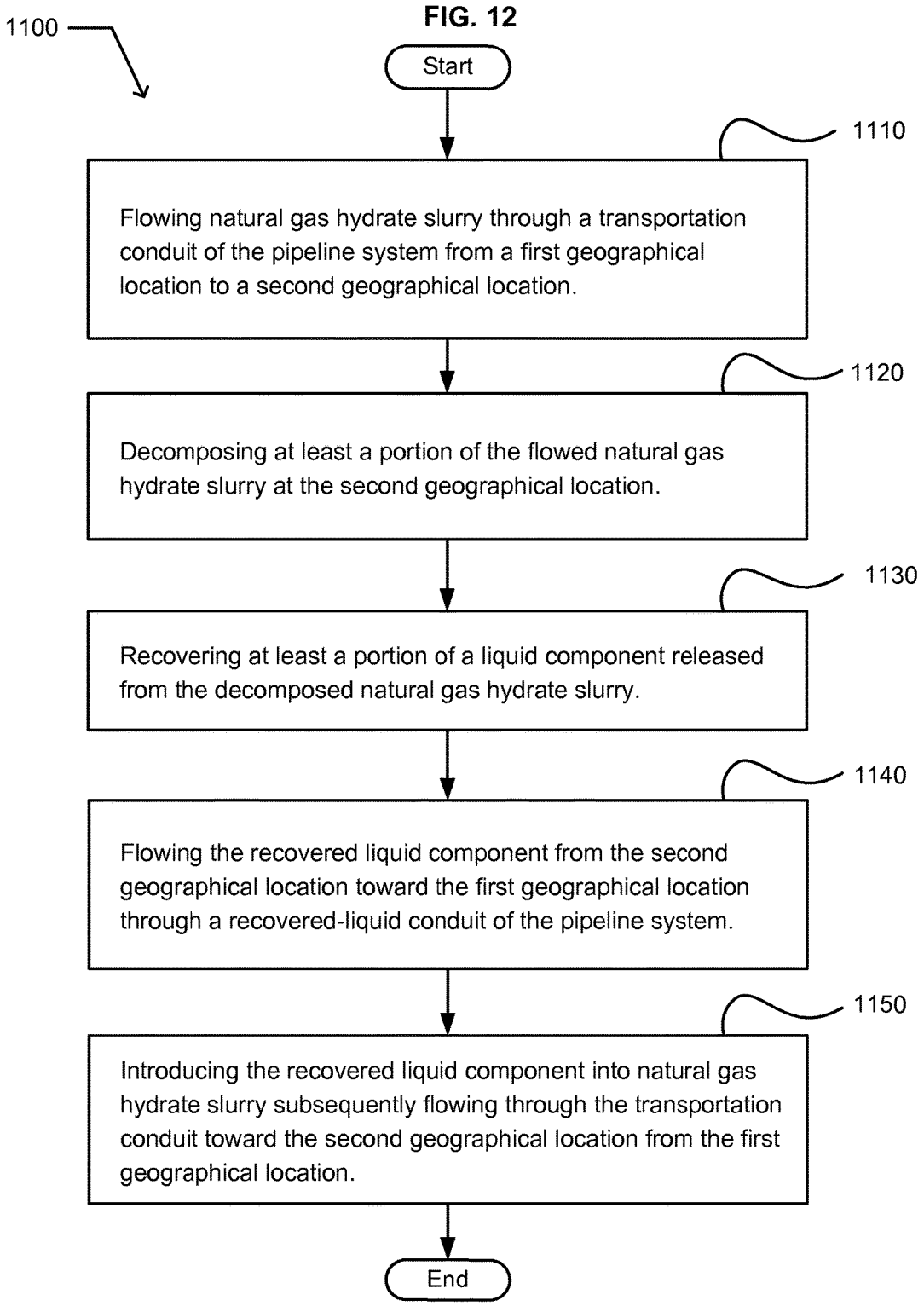
FIG. 12 illustrates an example operational flow 1100 implemented in a pipeline system that transports flowable natural gas hydrate slurries from a first geographical location to second geographical location.

FIG. 12 illustrates an example operational flow 1100 implemented in a pipeline system that transports flowable natural gas hydrate slurries from a first geographic location to a second geographic location, such as the first geographical location 122 to the second geographical location 124. After a start operation, the operation flow includes a fluid transport operation 1110. The fluid transport operation includes flowing natural gas hydrate slurry through a transportation conduit of the pipeline system from a first geographical location to the second geographical location. In an embodiment, the fluid transport operation may be implemented in part or in whole using the transportation conduit 1020 described in conjunction with FIG. 11. A separation operation 1120 includes decomposing at least a portion of the flowed natural gas hydrate slurry at the second geographical location. In an embodiment, the separation operation may be implemented in part or in whole using the decomposition system 1090 described in conjunction with FIG. 11. A reclamation operation 1130 includes recovering at least a portion of a liquid component released from the decomposed natural gas hydrate slurry. In an embodiment, the reclamation operation may be implemented in part or in whole using the reclamation system 1070 described in conjunction with FIG. 11. A recovered liquid transportation operation 1140 includes flowing the recovered liquid component from the second geographical location toward the first geographical location through a recovered-liquid conduit of the pipeline system. In an embodiment, the recovered liquid transportation may be implemented in part or in whole using the recovered-liquid conduit 1050 described in conjunction with FIG. 11. A mixing operation 1150 includes introducing the recovered liquid component into natural gas hydrate slurry subsequently flowing through the transportation conduit toward the second geographical location from the first geographical location. In an embodiment, the mixing operation may be implemented in part or in whole using the combiner system 1080 described in conjunction with FIG. 11. The operational flow includes an end operation.

In an embodiment, the operational flow 1100 includes absorbing heat from natural gas hydrate slurry flowing through the transportation conduit using the recovered liquid component flowing through the recovered-liquid conduit. In an embodiment, the operational flow includes chilling the recovered liquid component and forming an ice/liquid slurry recovered liquid component. In an embodiment, the operational flow includes reducing the pressure of the recovered liquid component flowing through the recovered-liquid conduit to achieve a target boiling point of the recovered liquid component selected to absorb heat from the flowing natural gas hydrate by undergoing a phase change. For example, the pressure of a recovered liquid component may be reduced to selected low vapor pressure such that the recovered liquid component evaporates or boils as it absorbs heat from the flowing natural gas hydrate slurry. For example, evaporated water from the recovered liquid component may be discarded by pumping out of the recovered-liquid conduit. For example, evaporated water from the recovered liquid component may be condensed and recycled in a closed-cycle system.

All references cited herein are hereby incorporated by reference in their entirety or to the extent their subject matter is not otherwise inconsistent herewith.

In some embodiments, "configured" includes at least one of designed, set up, shaped, implemented, constructed, or adapted for at least one of a particular purpose, application, or function.

It will be understood that, in general, terms used herein, and especially in the appended claims, are generally intended as "open" terms. For example, the term "including" should be interpreted as "including but not limited to." For example, the term "having" should be interpreted as "having at least." For example, the term "has" should be interpreted as "having at least." For example, the term "includes" should be interpreted as "includes but is not limited to," etc. It will be further understood that if a specific number of an introduced claim recitation is intended, such an intent will be explicitly recited in the claim, and in the absence of such recitation no such intent is present. For example, as an aid to understanding, the following appended claims may contain usage of introductory phrases such as "at least one" or "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a receiver" should typically be interpreted to mean "at least one receiver"); the same holds true for the use of definite articles used to introduce claim recitations. In addition, even if a specific number of an introduced claim recitation is explicitly recited, it will be recognized that such recitation should typically be interpreted to mean at least the recited number (e.g., the bare recitation of "at least two chambers," or "a plurality of chambers," without other modifiers, typically means at least two chambers).

In those instances where a phrase such as "at least one of A, B, and C," "at least one of A, B, or C," or "an [item] selected from the group consisting of A, B, and C," is used, in general such a construction is intended to be disjunctive (e.g., any of these phrases would include but not be limited to systems that have A alone, B alone, C alone, A and B together, A and C together, B and C together, or A, B, and C together, and may further include more than one of A, B, or C, such as $A_1$, $A_2$, and C together, A, $B_1$, $B_2$, $C_1$, and $C_2$ together, or $B_1$ and $B_2$ together). It will be further understood that virtually any disjunctive word or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The herein described aspects depict different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality. Any two components capable of being so associated can also be viewed as being "operably couplable" to each other to achieve the desired functionality. Specific examples of operably couplable include but are not limited to physically mateable or physically interacting components or wirelessly interactable or wirelessly interacting components.

With respect to the appended claims, the recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Use of "Start," "End," "Stop," or the like blocks in the block diagrams is not intended to indicate a limitation on the beginning or end of any operations or functions in the diagram. Such flowcharts or diagrams may be incorporated into other flowcharts or diagrams where additional functions are performed before or after the functions shown in the diagrams of this application. Furthermore, terms like "responsive to," "related to," or other past-tense adjectives are generally not intended to exclude such variants, unless context dictates otherwise.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A pipeline system comprising:

a transportation conduit containing a natural gas hydrate flowing from a first geographic location to a second geographic location;

a cooling conduit extending longitudinally in the same directions as the transportation conduit, the transportation conduit being disposed exterior to and radially outward from the cooling conduit, the cooling conduit having a heat-transfer surface thermally coupled with the flowing natural gas hydrate, and containing a heat-transfer fluid flowing between the first geographic location and the second geographic location, the flowing heat-transfer fluid having a target temperature range predicted to maintain a selected stability of the flowing natural gas hydrate;

a hydrate pump urging the flowing natural gas hydrate toward the second geographic location, wherein the hydrate pump includes a pressure controller configured to regulate the pressure of the contained natural gas hydrate flowing between the first geographic location and the second geographic location, the regulated pressure and the target temperature range predicted to maintain the selected stability of the natural gas hydrate flowing from the first geographic location to the second geographic location;

a cooling system configured to cool the heat-transfer fluid to the target temperature range;

a removal system configured to withdraw at least a portion of the heat-transfer fluid from the cooling conduit; and an injection system configured to introduce the withdrawn heat-transfer fluid into the cooling conduit after cooling of the withdrawn heat-transfer fluid by the cooling system.

2. The pipeline system of claim 1, wherein the flowing natural gas hydrate includes a natural gas hydrate able to flow, capable of flowing, or being flowed through the transportation conduit.

3. The pipeline system of claim 1, wherein the flowing natural gas hydrate includes a natural gas hydrate and a carrier fluid.

4. The pipeline system of claim 3, wherein the carrier fluid includes water or a flowable hydrocarbon.

5. The pipeline system of claim 1, wherein the flowing natural gas hydrate includes a flowing clathrate or semi-clathrate composition with $H_2O$ as a host molecule and a natural gas as a guest molecule.

6. The pipeline system of claim 1, wherein the cooling conduit is located within the transportation conduit.

7. The pipeline system of claim 1, wherein the cooling conduit and the transportation conduit share a common thermally conductive wall portion.

8. The pipeline system of claim 1, wherein the heat-transfer fluid includes a flowable solid-liquid phase slurry.

9. The pipeline system of claim 1, wherein the heat-transfer fluid includes a flowable ice-water slurry.

10. The pipeline system of claim 1, wherein the heat-transfer fluid includes a flowable hydrocarbon fluid.

11. The pipeline system of claim 1, wherein the heat-transfer fluid includes water.

12. The pipeline system of claim 1, wherein the heat-transfer fluid and a carrier fluid of the natural gas hydrate are substantially the same material.

13. The pipeline system of claim 1, wherein the target temperature range includes a temperature range predicted to maintain the selected stability of the flowing natural gas hydrate during a transit of a portion of the transportation conduit.

14. The pipeline system of claim 13, wherein the target temperature range includes a temperature range predicted to maintain a decomposition rate of less than 10% of the flowing natural gas hydrate per 1000 km transit of the transportation conduit.

15. The pipeline system of claim 13, wherein the target temperature range includes a temperature range predicted to maintain a decomposition rate of less than 1% of the flowing natural gas hydrate per 1000 km transit of the transportation conduit.

16. The pipeline system of claim 1, wherein the target temperature range includes a temperature range predicted to maintain the flowing natural gas hydrate at least substantially within its hydrate stability range during transit of a portion of the transportation conduit.

17. The pipeline system of claim 1, wherein the target temperature range includes a temperature range demonstrated to maintain the selected stability of the flowing natural gas hydrate during a transit of a portion of the transportation conduit.

18. The pipeline system of claim 1, wherein the target temperature range includes a target temperature range (i) lower than the ambient temperature surrounding the transportation conduit and (ii) predicted to maintain the selected stability of the flowing natural gas hydrate.

19. The pipeline system of claim 1, wherein the heat-transfer fluid is selected to absorb heat from the flowing natural gas hydrate and undergo a phase change.

20. The pipeline system of claim 1, further comprising:

an exhaust system configured to vent a portion of the heat-transfer fluid after the heat-transfer fluid has undergone a phase change.

21. The pipeline system of claim 1, further comprising a return-conduit running between the second geographical location and the first geographical location, the return conduit containing a portion of the heat-transfer fluid withdrawn from the cooling conduit at the second geographical location and flowing the withdrawn heat-transfer fluid from the second geographical location toward the first geographical location.

22. The pipeline system of claim 1, wherein the cooling system is powered at least in part by combustion of natural gas released by decomposition of the flowing natural gas hydrate contained in the transportation conduit.

23. The pipeline system of claim 1, wherein at least a portion of the cooling conduit includes a capillary member configured to provide the flow of the heat-transfer fluid either from the first geographical location toward the second geographical location, or from the second geographical location toward the first geographical location.

24. The pipeline system of claim 1, further comprising:

a fluid pump urging the flowing of the heat-transfer fluid from the first geographical location toward the second geographical location, or from the second geographical location toward the first geographical location.

25. The pipeline system of claim 1, further comprising:

an insulating material thermally separating the transportation conduit from ambient temperature of the environment surrounding the transportation conduit.

26. The pipeline system of claim 1, further comprising:

a controller configured to control a pressure or temperature of the heat-transfer fluid.

27. A pipeline system comprising:

a transportation conduit containing a natural gas hydrate flowing from a first geographic location to a second geographic location;

a cooling conduit extending longitudinally in the same directions as the transportation conduit, the transportation conduit being disposed exterior to and radially outward from the cooling conduit, the cooling conduit having a heat-transfer surface thermally coupled with the flowing natural gas hydrate, and containing a heat-transfer fluid flowing between the first geographic location and the second geographic location, the flowing heat-transfer fluid having a target temperature range predicted to maintain a selected stability of the flowing natural gas hydrate;

a pressure sensor responsive to a pressure of the natural gas hydrate;

a cooling system configured to cool the heat-transfer fluid to the target temperature range;

a removal system configured to withdraw at least a portion of the heat-transfer fluid from the cooling conduit; and an injection system configured to introduce the withdrawn heat-transfer fluid into the cooling conduit after cooling of the withdrawn heat-transfer fluid by the cooling system.

* * * * *